US011572254B2

(12) United States Patent
Kashiwakura

(10) Patent No.: US 11,572,254 B2
(45) Date of Patent: Feb. 7, 2023

(54) ELEVATOR DOOR ENGAGEMENT DEVICE

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 0 days.

(21) Appl. No.: 17/179,991

(22) Filed: Feb. 19, 2021

(65) Prior Publication Data

US 2021/0276829 A1 Sep. 9, 2021

(30) Foreign Application Priority Data

Mar. 3, 2020 (JP) ..... JP2020-035624

(51) Int. Cl.
*B66B 13/12* (2006.01)
*B66B 13/20* (2006.01)

(52) U.S. Cl.
CPC ..... *B66B 13/12* (2013.01); *B66B 13/20* (2013.01)

(58) Field of Classification Search
CPC ..... B66B 13/12; B66B 13/20
See application file for complete search history.

(56) References Cited

U.S. PATENT DOCUMENTS 2,481,124 A * 9/1949 Kruger ..... B66B 13/12 187/319
6,070,700 A * 6/2000 Nagel ..... B66B 13/12 187/331
10,392,229 B2 * 8/2019 Salvenmoser ..... B66B 13/12
2021/0276830 A1 * 9/2021 Kashiwakura ..... B66B 13/12

FOREIGN PATENT DOCUMENTS

| | | | | |
|---|---|---|---|---|
| CN | 106744199 A * | 5/2017 | | |
| DE | 0829447 A1 * | 1/1997 | | |
| DE | 202014102534 U1 * | 9/2015 | ..... | B66B 13/12 |
| EP | 2157040 A1 | 2/2010 | | |
| WO | 2008149456 A1 | 12/2008 | | |
| WO | WO-2011072891 A1 * | 6/2011 | ..... | B66B 13/12 |

OTHER PUBLICATIONS

Machine translation of CN 106744199A.*
English translation of WO 2011/072891.*

* cited by examiner

*Primary Examiner* — Diem M Tran
(74) *Attorney, Agent, or Firm* — The Webb Law Firm

(57) ABSTRACT

Provided is a door engagement device including an engaging body including an engaging part, the engaging part being configured to engage with an engaged part provided on a driven door that is either one of the landing door and the car door of an elevator, and transmit a driving force that moves a driving door in an opening and closing direction to the driven door, the driving door being the remaining one of the landing door and the car door; and a base that is connected to the driving door and the engaging body. The position of the engaging part is changeable relative to the base in an aligning direction, in which the landing door and the car door align with each other when the landing and car doors are opened and closed.

6 Claims, 17 Drawing Sheets

ELEVATOR DOOR ENGAGEMENT DEVICE

CROSS-REFERENCE TO RELATED APPLICATION

This application claims priority to Japanese Patent Application No. 2020-035624 filed Mar. 3, 2020, the disclosure of which is hereby incorporated by reference in its entirety.

BACKGROUND OF THE INVENTION

Field of the Invention

The present invention relates to an elevator door engagement device for an elevator that is configured to transmit driving force to open and close a car door to a landing door or vice versa.

Description of Related Art

Conventionally, an elevator door engagement device that is configured to transmit driving force to open and close a car door to a landing door has been known (WO 2008/149456 A). The elevator door engagement device is engageable with a so-called interlock which is a mechanism for preventing a landing door from being opened from a landing floor side when a car does not land on the landing floor. Specifically, the engagement device includes a pair of angle members as an engaging part to hold an engaged part from both sides in a door opening and closing direction. The interlock includes the engaged part to be engaged with the engagement device. The engaged part is, for example, constituted by interlock rollers connected to the landing door.

In the engagement device, the interlock is locked when the car does not land on the landing floor. Thereby, the landing door is locked in a fully-closed state. Also in the engagement device, when the car lands on the landing floor and the car door starts to open, the pair of angle members move in association with the movement of the car door to cause the interlock roller to move by being pushed by the pair of angle members moving from both sides. Thereby, the interlock is unlocked. The opening and closing of the car door in this state (in the state where the interlock rollers are clamped by the pair of angle members) causes transmission of the driving force for opening and closing the car door to the landing door via the engagement device. Thereby, the landing door opens and closes in association with the car door.

In order to allow the engagement device to open and close the landing door in association with the car door, it is essential that the interlock rollers be located between the pair of angle members. Further, in order to allow the opening and closing operations of the doors in association with each other, the landing door and the car door needs to keep a constant distance therebetween in the depth direction because the interlock roller is connected to the landing door, while the pair of angle members are connected to the car door. However, the distance between a car sill line and an opposite surface of the car door facing the landing floor may vary from elevator to elevator or from unit of elevators to unit of elevators, thereby causing variation in the distance between the landing door and the car door in the depth direction.

For example, the distance between the car sill line and the opposite surface of the car door facing the landing floor in the depth direction (hereinafter also referred to as "depth distance") is a given distance in many elevators manufactured by the same manufacture. However, some elevators manufactured even by the same manufacture may have the depth distance smaller than the given distance. In order to utilize a single engagement device for elevators respectively having different depth distances, the engagement device is required to have a suitable design to the elevator having a small depth distance so as to be adopted in such an elevator (i.e. the elevator having a small depth distance). However, in the case where the engagement device designed to be suitable to the elevator having a small depth distance is adopted in many other elevators (i.e. the elevators having a given depth distance), the engaging part needs to be raised, using a sim or a spacer, to be arranged at a position where the engaging part can be engaged with the engaged part. Therefore, work efficiency in adopting the engagement device in the elevators has been decreased.

Further, in the case where the engagement device is applied to an existing elevator manufactured by a different manufacture, the depth distance that varies depending on the manufacture needs to be taken into account. In this case, it is conceivable to use an engagement device that is produced with a the actually measured value of the depth distance obtained by actually measuring the depth distance of the elevator to be applied with the engagement device. In this case, however, the actual measurement of the depth distance imposes a heavy workload, and therefore there was a concern about causing an influence on the shipping schedule of the engagement device due to the production necessitating the actual measurement beforehand.

SUMMARY OF THE INVENTION

It is an object of the present disclosure to provide an elevator door engagement device that can be commonly adopted in any elevators even in the case where the elevators have different distances between a landing door and a car door in the depth direction.

For improving the basic understanding on the some features of the invention of the present application, a brief summary of the present invention will be described below. This summary does not show the outline of the present invention, and is not intended to specify the main or important features of the present invention or to limit the scope of the present invention. The purpose thereof is only to provide some of basic concepts of the invention in a simplified style as a premise of the subsequent detailed description of the invention.

The elevator door engagement device of the present disclosure is a door engagement device configured to be mounted to an opposite surface of a car door facing a landing door or an opposite surface of the landing door facing the car door, the elevator door engagement device including: an engaging body including an engaging part, the engaging part being configured to engage with an engaged part provided on a driven door that is either one of the landing door and the car door, and transmit a driving force that moves a driving door in an opening and closing direction to the driven door, the driving door being the remaining one of the landing door and the car door; and a base that is connected to the driving door and the engaging body, wherein the position of the engaging part is changeable relative to the base in an aligning direction, in which the landing door and the car door align with each other when the landing and car doors are opened and closed.

The door engagement device may be configured such that the engaging body or the base has an elongated hole extending in the aligning direction, and the elevator door engagement device further includes a fixing part that is configured to pass through the elongated hole to fix the engaging part so as to allow the position of the engaging part to be changeable with respect to the aligning direction.

The door engagement device may be configured such that the engaging part includes: a first engaging section that extends in a vertical direction; and a second engaging section that extends in the vertical direction and aligns with the first engaging section in the opening and closing direction so as to be able to clamp the engaged part in cooperation with the first engaging section, and the engaging body further includes: an engagement support part that supports the engaging part, and includes a first support section that supports the first engaging section and a second support section that supports the second engaging section; an interlock part that interlocks the first support section and the second support section together; and a link part that is provided between the engaging part and the base, and includes: a first link section that connects the first engaging section to the base so as to allow the first engaging section to be movable relative to the base in the opening and closing direction; and a second link section that connects the second engaging section to the base so as to allow the second engaging section to be movable relative to the base in the opening and closing direction.

The door engagement device may be configured such that the interlock part includes an auxiliary restricting section that extends in the vertical direction and the aligning direction and is configured to be able to come into contact with the second engaging section to thereby restrict the second engaging section from moving in the opening and closing direction.

The door engagement device may be configured such that the engaging part includes: a first engaging section that extends in a vertical direction; and a second engaging section that extends in the vertical direction and aligns with the first engaging section in the opening and closing direction of the landing and car doors so as to be able to clamp the engaged part in cooperation with the first engaging section, and the engaging body further includes: an engagement support part that supports the engaging part, and includes a first support section that supports the first engaging section and a second support section that supports the second engaging section, each of the first support section and the second support section is provided with a jack member that is configured to jack up the first support section and the second support section so as to allow the positions of the first support section and the second support section to be changeable with respect to the aligning direction, and the position of the engaging part is changeable with respect to the aligning direction through the jack-up of the first support section and the second support section by the jack member.

The door engagement device may be configured such that the engaging body includes an interlock part that interlocks the first support section and the second support section together, and the jack member is configured to jack up the interlock part at the time of the jack-up of the first support section and the second support section.

As described above, according to the above disclosure, an elevator door engagement device that can be commonly adopted in any elevators even in the case where the elevators have different distances between the landing door and the car door in the depth direction can be provided.

BRIEF DESCRIPTION OF DRAWINGS

The aforementioned features and the other features of the present invention will be clarified by the following description and figures illustrating the embodiments of the present invention.

DESCRIPTION OF THE INVENTION

Hereinafter, an embodiment of the present invention will be described with reference to FIG. 1 to FIG. 10.

Figure 1:
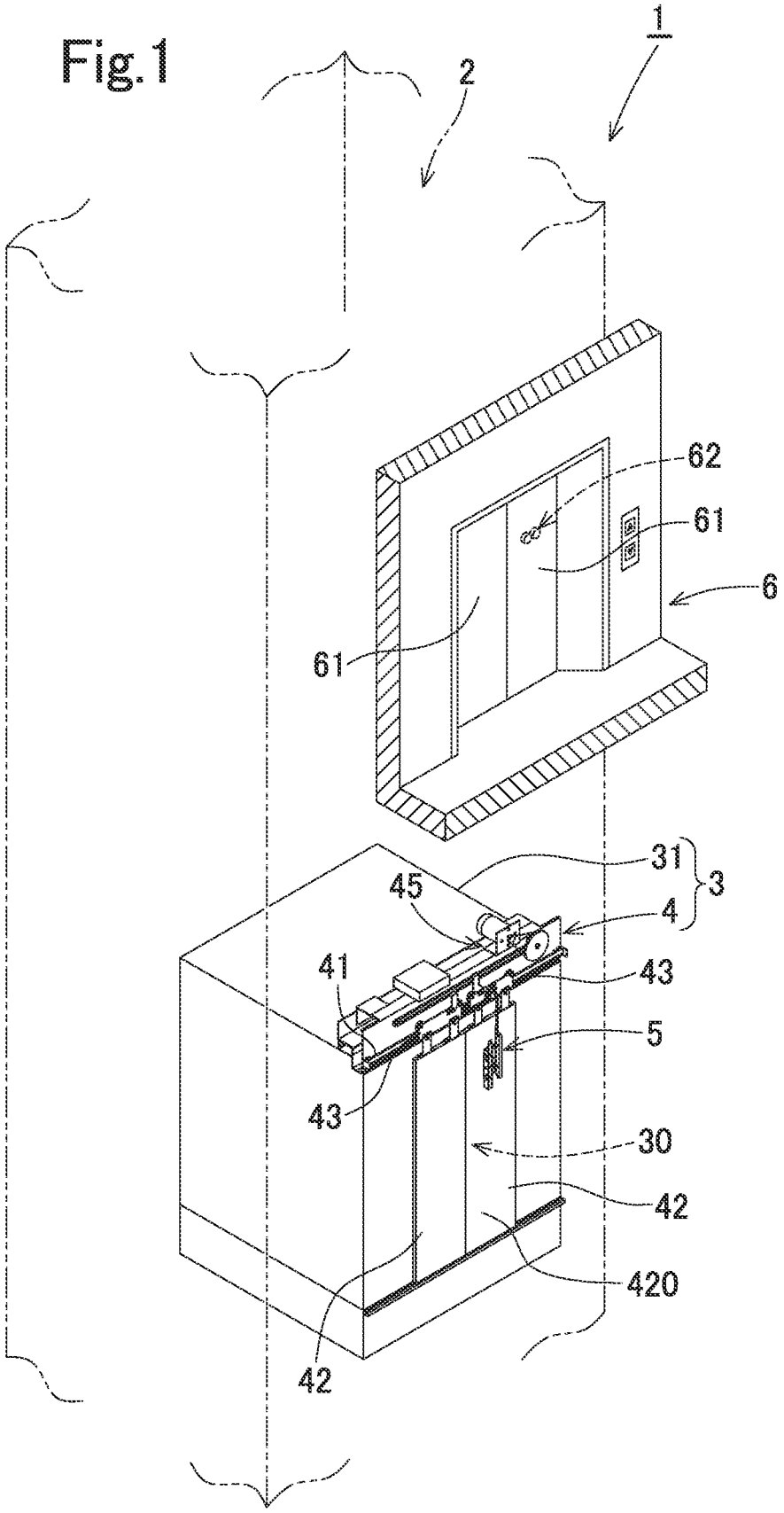
FIG. 1 is a schematic diagram showing a configuration of an elevator mounted with a door engagement device according to this embodiment.

As shown in FIG. 1, an elevator door engagement device (hereinafter also referred to simply as "engagement device") according to this embodiment is mounted to an elevator 1 including an elevator shaft 2 that extends in the vertical direction throughout a plurality of floors in a building, and a car 3 that is raised or lowered within the elevator shaft 2. An engagement device 5 is mounted to a car door 42 that is a driving door to open and close an entrance 30 of the car 3.

The engagement device 5 is configured to engage with a landing door 61 (specifically, engaged part 62 connected to the landing door 61) when the car 3 lands on a desired floor (i.e. the landing floor). The engagement device 5 is configured to engage with the landing door 61 (engaged part 62) that is a driven door, to thereby make the landing door 61 follow the motion of the car door 42 when the car door 42 opens and closes.

The car 3 includes a car body 31 having the entrance 30, and a door device 4 having the car door 42 and arranged in the car body 31. The engagement device 5 is mounted to the car door 42 of the door device 4. In the door device 4 of this embodiment, the engagement device 5 is mounted to an opposite surface 420 of the car door 42 facing the landing door 61.

Figure 2:
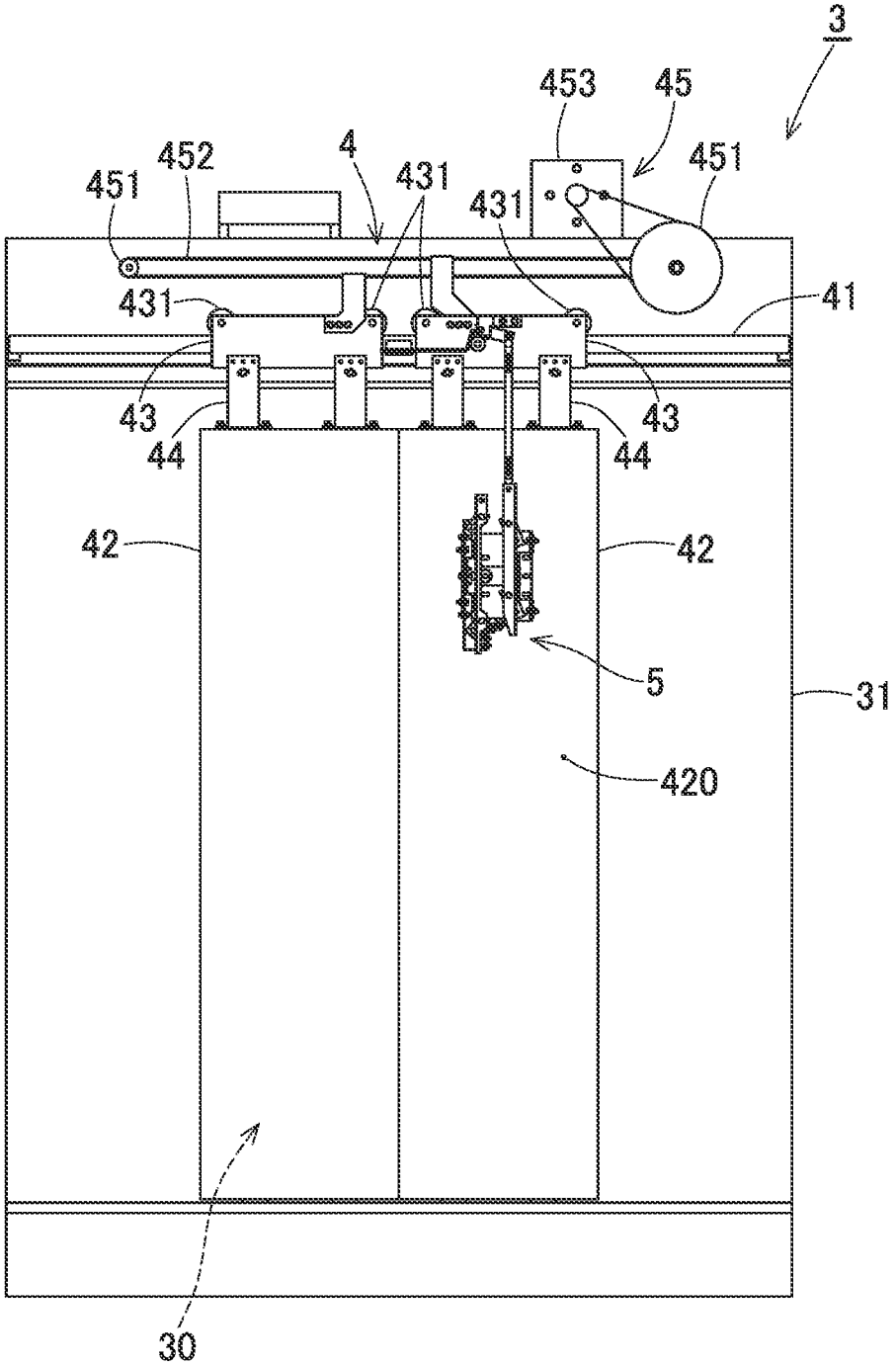
FIG. 2 is a front view of a car of the elevator.

As shown in FIG. 2, the door device 4 includes a guide rail 41 that extends in the width direction (i.e. the left-right direction in FIG. 2: the opening and closing direction of the landing door 61 and the car door 42, hereinafter also referred to as "the opening and closing direction") above the entrance 30 of the car 3, the car door 42 that is configured to open and close the entrance 30 of the car body 31, and a door hanger 43 that allows the car door 42 to reciprocate along the guide rail 41 while allowing the car door 42 to hang down therefrom. The door device 4 of this embodiment is a so-called center open type door device and the car door 42 includes two car door panels that can move toward and away from each other in the opening and closing direction.

The door device 4 also includes a driving device 45 or the like. The driving device drives the car door 42 via the door hanger 43 in the opening and closing direction. The driving device 45 is arranged in the car body 31 and drives the car door 42 directly or indirectly.

Specifically, the driving device 45 includes a plurality of pulleys 451 that are mounted at an interval in the opening and direction above the guide rail 41, an endless annular belt body 452 that is wound around the plurality of pulleys 451, and a motor 453 that rotary drives at least one of the plurality of pulleys 451.

The guide rail 41 extends in the opening and closing direction above the entrance 30 of the car body 31 to guide the car doors 42 (specifically, the door hanger 43 with the car door 42 hanging down therefrom). The guide rail 41 of this embodiment is configured to guide each of the two car door panels constituting the car door 42. Each of the two car door panels constituting the car door 42 is a panel having a vertically elongated rectangular shape.

The door hanger 43 is connected to the belt body 452 of the driving device 45 and is reciprocatable along the guide rail 41 while having the car door 42 directly or indirectly hanging down therefrom. The door hanger 43 of this embodiment allows the car door 42 to hang down therefrom via an intermediate member 44. The door hanger 43 includes a plurality of rollers 431 that roll on the guide rail 41 when reciprocating along the guide rail 43.

The engagement device 5 transmits driving force to open and close the car door 42 to the landing door 61 (see FIG. 1). The engagement device 5 is mounted to the opposite surface 420 of the car door 42 and is engageable with the engaged part 62 of the landing door 61 when the car 3 lands on a desired floor. The engagement device 5 of this embodiment is mounted to one of the two car door panels constituting the car door 42. Specifically, the engagement device 5 is mounted to the car door panel on the right side of the two car door panels constituting the car door 42 as viewed from the landing floor 6 side.

The engaged part 62 of the landing door 61 of this embodiment is a so-called catch roller. The engaged part 62 is constituted by two catch rollers that can move toward and away from each other in the door opening and closing direction.

Also as shown in FIG. 3 to FIG. 6, the engagement device 5 includes an engaging body 500 that includes an engaging part 50 that is configured to engage with the engaged part 62 of the landing door 61 to thereby be able to transmit driving force to open and close the car door 42 to the landing door 61, and a base 53 that is connected to the car door 42 and the engaging body 500. In the engagement device 5, the position of the engaging part 50 is changeable relative to the base 53 in an aligning direction of the landing door 61 and the car door 42 at the time of opening and closing the landing door 61 and the car door 42 (i.e. perpendicular to a paper plane of FIG. 3 to FIG. 6, hereinafter referred to simply as "aligning direction"). In the engagement device 5 of this embodiment, the position of the engaging part 50 is changeable relative to the base 53 along with the engaging body 500.

The opening and closing timing of the landing door 61 and the car door 42 coincides with the timing at which the car door 42 and the landing door 61 face (overlap) each other in other words. The aligning direction at the time of opening and closing the landing door 61 and the car door 42 (aligning direction) is also referred to as "depth direction (e.g. depth direction of the elevator shaft 2 or depth direction of the car 3)".

The engagement device 5 of this embodiment includes a fixing part 54 that fixes the position of the engaging part 50 changeably with respect to the aligning direction. The engagement device 5 of this embodiment (specifically, the engaging body 500) includes an engagement support part 55 that supports the engaging part 50, an interlock part 56 that interlocks the parts or members that constitute the engagement support part 55, and a link part that is provided between the engaging part 50 and the base 53. The engagement device 5 of this embodiment further includes a driving mechanism 58 that drives the engaging part 50. The engagement device 5 of this embodiment includes a restricting part 59 that restricts the motion of the first engaging section 51.

The engaging part 50 is a member that is, for example, able to clamp the engaged part 62. The engaging part 50 of this embodiment includes a first engaging section 51 that extends in a vertical direction and a second engaging section 52 that extends in the vertical direction and aligns with the first engaging section 51 in the opening and closing direction.

Figure 7A:
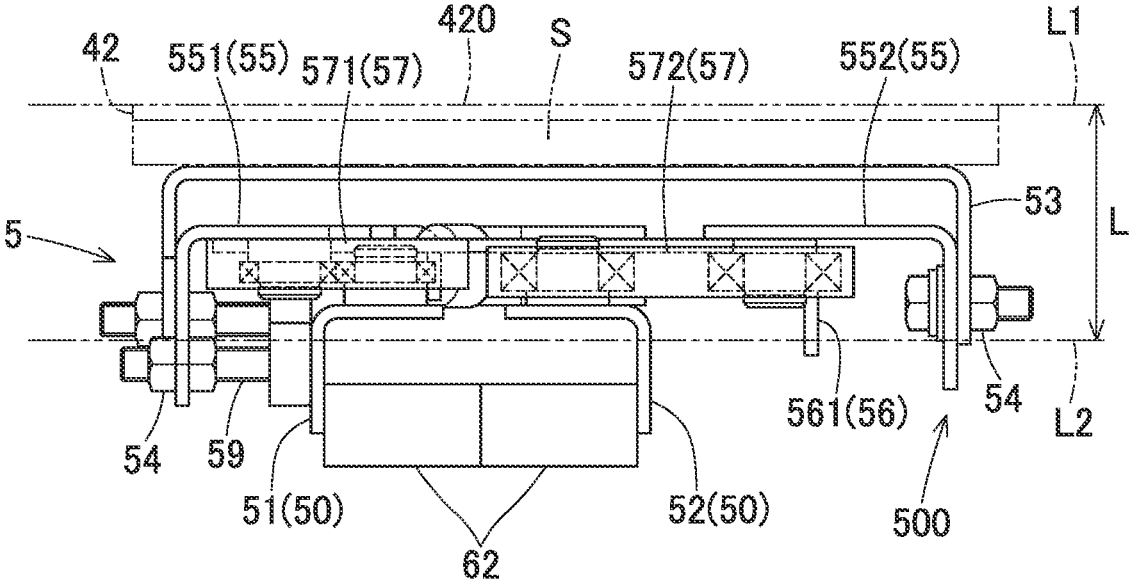
FIG. 7A is a top view of the engagement device in which the engaging part is set at a first position.
Figure 7B:
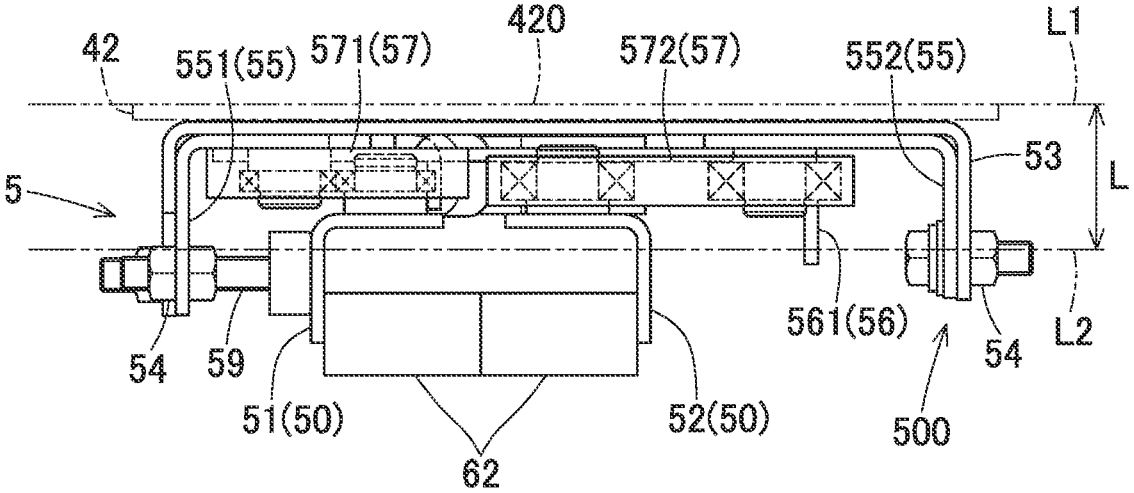
FIG. 7B is a top view of the engagement device in which the engaging part is set at a second position.

The position of the engaging part 50 relative to the base 53 in the aligning direction is changeable between at least two positions as shown in FIG. 7A and FIG. 7B, specifically, a first position at which the engaging part 50 is located on the far side from the base 53 in the aligning direction (see FIG. 7A, in which the engaging part 50 is located on the lowermost side at the first position) and a second position at which the engaging part 50 is located closest to the base 53 (see FIG. 7B, in which the engaging part 50 is located on the uppermost side at the second position). In this embodiment, the position of the engaging part 50 relative to the base 53 in the aligning direction is changeable between the two positions in a non-stepwise manner. That is, the position of the engaging part 50 relative to the base 53 in the aligning direction can be fixed at any position between the first position and the second position.

Figure 5:
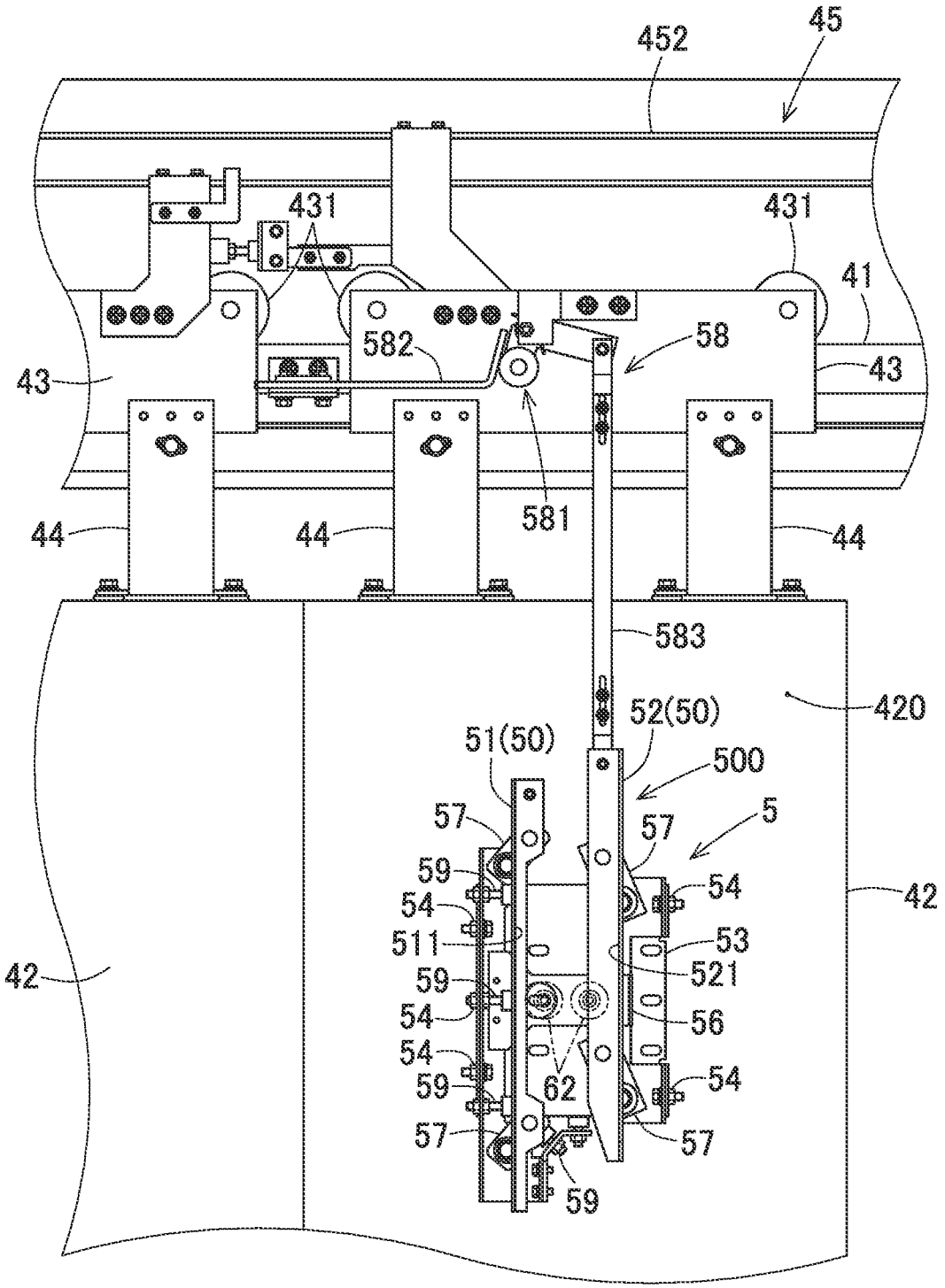
FIG. 5 is an explanatory diagram for the motion of the engagement device in the state where the engagement device does not hold the engaged part of the landing door.
Figure 6:
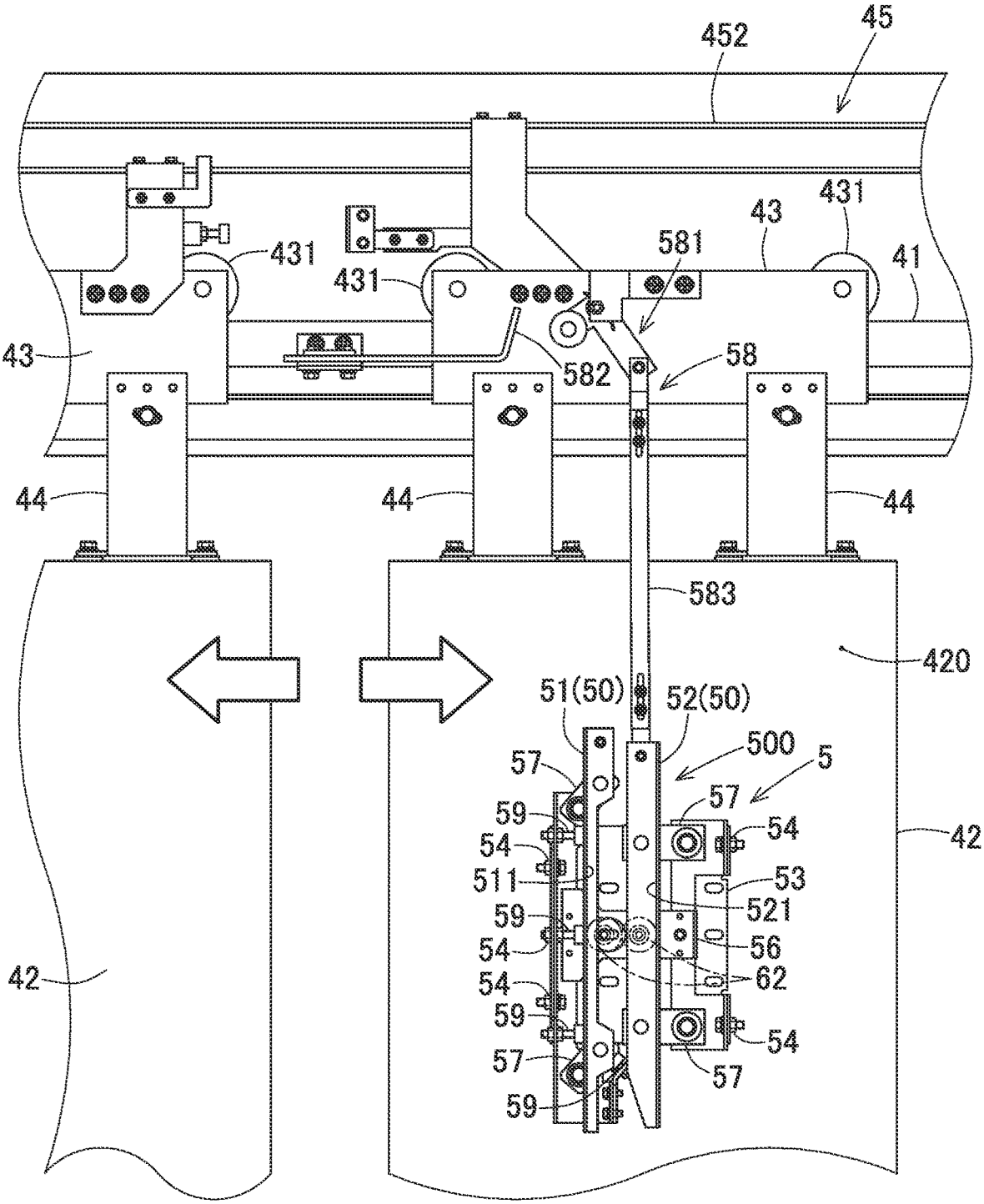
FIG. 6 is an explanatory diagram for the motion of the engagement device in the state where the engagement device holds the engaged part of the landing door.

The first engaging section 51 is a member that can come into contact with the engaged part 62 from the door closing direction side (from the opposite side to the door stopper in the door opening and closing direction, that is, from the left side in FIG. 5 and FIG. 6). The first engaging section 51 has a first holding surface 511 expanding in the vertical direction and the aligning direction and facing toward the door opening direction side (toward the door stopper side in the door opening and closing direction, that is, toward the right side in FIG. 5 and FIG. 6). The position of the first engaging section 51 of this embodiment is changeable relative to the base 53 in the aligning direction. The first engaging section 51 of this embodiment is a so-called angle member extending in the vertical direction and having an L-shape in the cross section.

The first engaging section 51 of this embodiment further includes a connection part 512 to which an elongated transmission member (for example, elongated transmission member 462 used in the second embodiment to be described later, see FIG. 12) is connectable (see FIG. 3 and FIG. 4). The transmission member 462 is, when the door device 4 includes a locking mechanism for locking and unlocking the car door 42, a member for transmitting the motion of the first engaging section 51 to the locking mechanism. The connection part 512 of this embodiment includes a hole, through which a bolt for connection of the transmission member 462 is inserted, and the like.

The second engaging section 52 is a member that can come into contact with the engaged part 62 from the door opening direction side. The second engaging section 52 has a second holding surface 521 expanding in the vertical direction and the aligning direction and facing toward the door closing direction side (toward the left side in FIG. 3 and FIG. 4). The second engaging section 52 is able to clamp the engaged part 62 in cooperation with the first engaging section 51. The position of the second engaging section 52 of this embodiment is changeable relative to the base 53 in the aligning direction. The second engaging section 52 of this embodiment is a so-called angle member extending in the vertical direction and having an L-shape in the cross section.

The base 53 has a base body section 531 expanding along the car door 42 (specifically, along the opposite surface 420 of the car door 42). The base 53 (specifically, the base body section 531) is fixed to the opposite surface 420 of the car door 42. The base 53 further has a base extending section 532 extending from the base body section 531 in the depth direction.

The base extending section 532 extends from two places aligned in the door opening and closing direction of the base body section 531 in the depth direction (specifically, toward the landing floor 6 side). The base extending section 532 of this embodiment includes a first base extending section 533 extending from one end on the door closing side of the base body section 531 (the left end in FIG. 3 and FIG. 4) and a second base extending section 534 extending from another end on the door opening side of the base body section 531 (the right end in FIG. 3 and FIG. 4). The base extending section 532 of this embodiment is provided with a plurality of screw holes 535 as shown in FIG. 9 and FIG. 10.

Specifically, the first base extending section 533 has a substantially rectangular shape (see FIG. 9). The second base extending section 534 is constituted by a pair of substantially rectangular sections vertically extending and respectively arranged at both ends on the door opening side of the base body section 531 (see FIG. 10).

As the screw holes 535 of this embodiment, at least one screw hole, preferably two or more screw holes are provided in each of the first base extending section 533 and the second base extending section 534. Specifically, the screw hole 535 is arranged at a position at which the screw hole 535 can overlap with an elongated hole 550 to be described later.

The engagement support part 55 may be constituted by a single member or a plurality of members. The engagement support part 55 of this embodiment includes a first support section 551 that supports the first engaging section 51 and a second support section 552 that supports the second engaging section 52 (see FIG. 3 and FIG. 4). The engagement support part 55 of this embodiment is provided with at least one elongated hole 550 having an elongated shape in the aligning direction (see FIG. 9 and FIG. 10).

Figure 3:
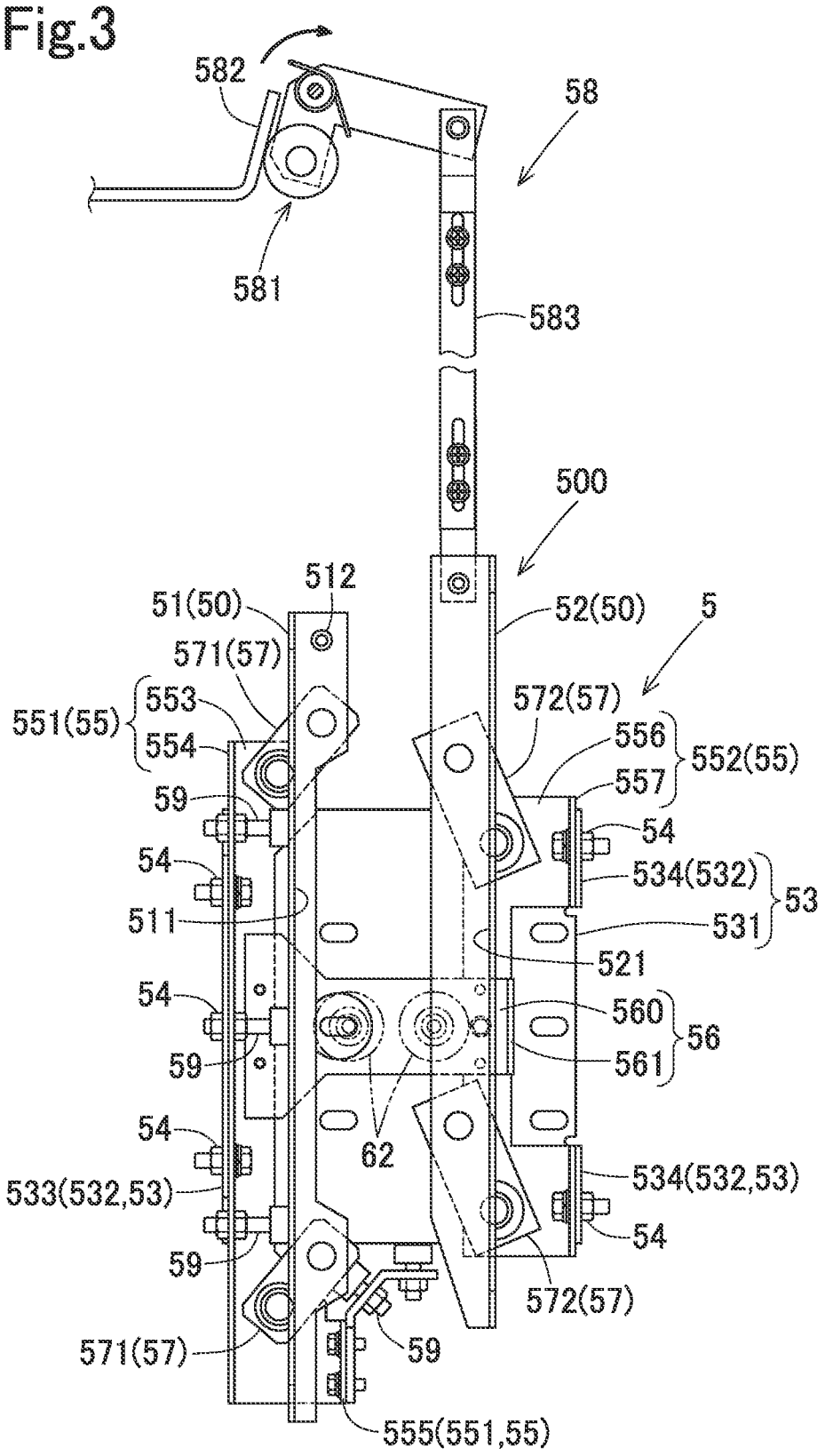
FIG. 3 is an explanatory diagram for the configuration of the engagement device arranged in a door device of the elevator in the state where the engagement device does not hold an engaged part of a landing door.
Figure 4:
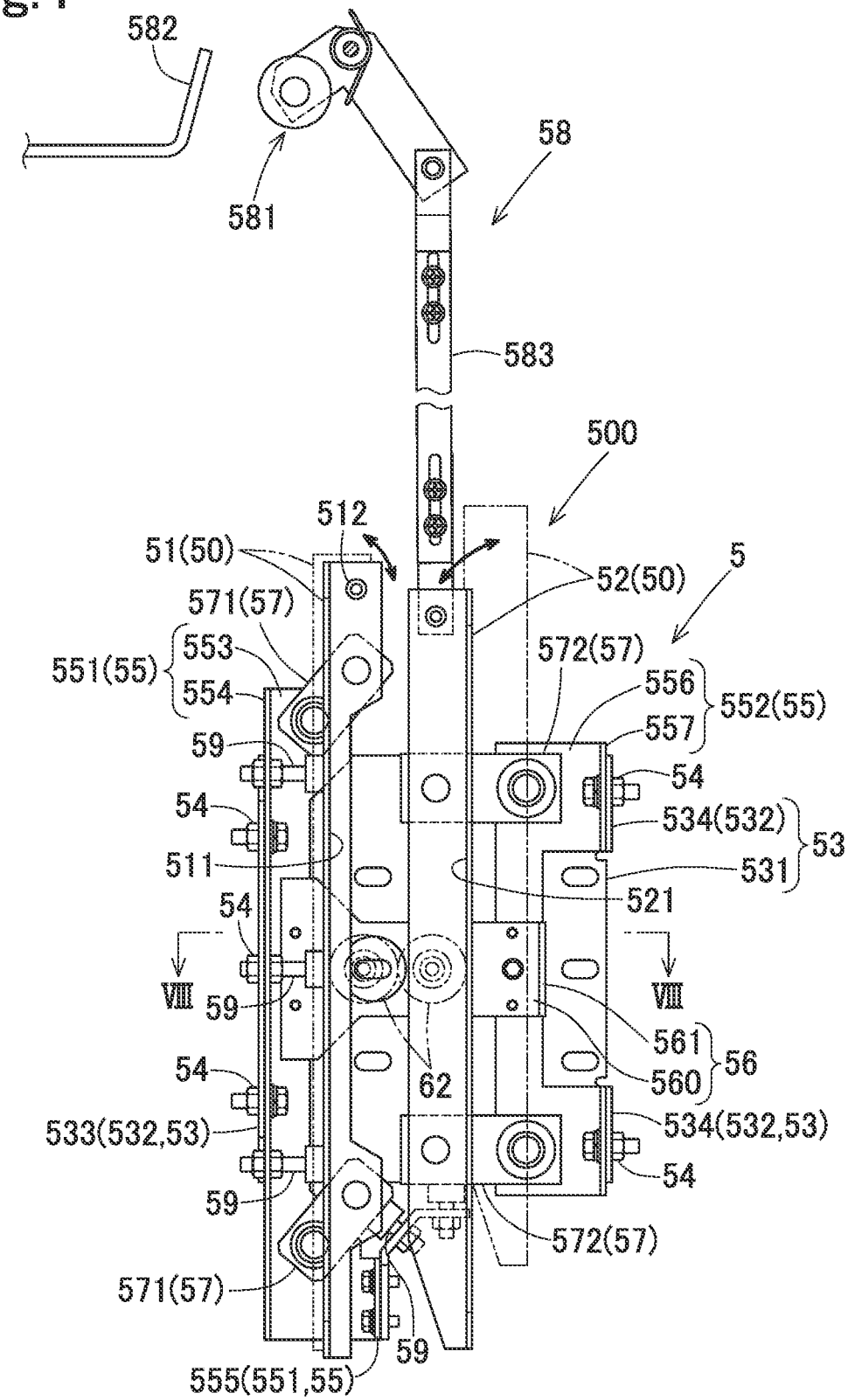
FIG. 4 is an explanatory diagram for the configuration of the engagement device arranged in the door device of the elevator in the state where the engagement device holds the engaged part of the landing door.

The first support section 551 has a first body section 553 expanding along the car door 42 (specifically, along the opposite surface 420 of the car door 42) and a first extending section 554 extending from the first body section 553 in the depth direction (specifically, toward the landing floor 6 side) (see FIG. 3 and FIG. 4). The first support section 551 of this embodiment has an auxiliary extending section 555 that is located at the position away from the first extending section 554 and extends from the first body section 553 in the depth direction (specifically, toward the landing floor 6 side).

In the first support section 551 of this embodiment, the first extending section 554 extends from one end in the door closing direction of the first body section 553 (the left end in FIG. 3 and FIG. 4) and the auxiliary extending section 555 extends from another end in the door opening direction of the first body section 553 (the right end in FIG. 3 and FIG. 4). Specifically, the first extending section 554 has a rectangular plate shape.

The second support section 552 has a second body section 556 expanding along the car door 42 (specifically, along the opposite surface 420 of the car door 42) and a second extending section 557 extending from the second body section 556 in the depth direction (specifically, toward the landing floor 6 side). In the second support section 552 of this embodiment, the second extending section 557 extends from one end in the door opening direction of the second body section 556 (the right end in FIG. 3 and FIG. 4). Specifically, the second extending section 557 is constituted by a pair of substantially rectangular sections vertically extending and respectively arranged at both ends on the door opening side of the second body section 556.

The elongated hole 550 is provided in at least one of the first support section 551 and the second support section 552 (see FIG. 9 and FIG. 10). For example, at least one elongated hole 550 is provided in each of the first support section 551 and the second support section 552. The elongated holes 550 are located at the same positon relative to the depth direction, and have the same dimension and shape relative to the depth direction. That is, the elongated holes 550 have their end edges on the landing floor 6 side aligning with each other relative to the depth direction (end edges on the left side in FIG. 9 and FIG. 10). Also, the elongated holes 550 have their end edges on the car body 31 side aligning with each other relative to the depth direction (end edges on the right side in FIG. 9 and FIG. 10).

Figure 9A:
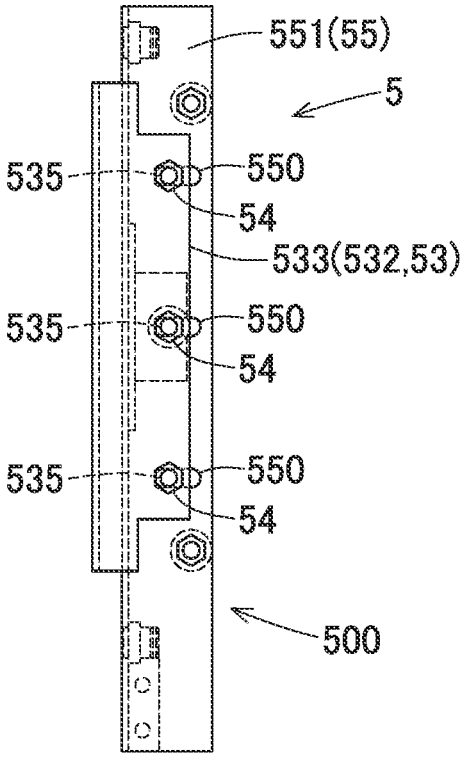
FIG. 9A is a left side view of the engagement device in which the engaging part is set at the first position.
Figure 9B:
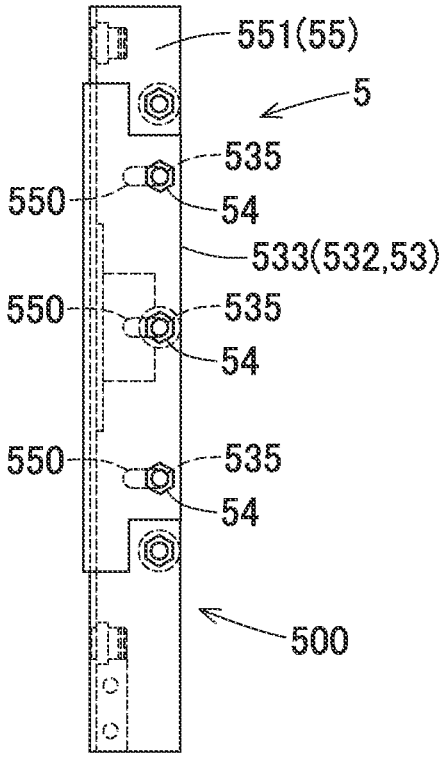
FIG. 9B is a left side view of the engagement device in which the engaging part is set at the second position.

A plurality of elongated holes 550 of this embodiment are provided in the first support section 551 as shown in FIG. 9A and FIG. 9B. The elongated holes 550 are arranged at at least both ends in the vertical direction of the first support section 551. Specifically, three elongated holes 550 are provided in the first support section 551 and arranged with a distance from each other in the vertical direction. That is, the elongated holes 550 are arranged at both ends in the vertical direction of the first support section 551 and at a position in an area between both ends in the vertical direction of the first support section 551. The elongated holes 550 are arranged in the first support section 551 at equal intervals in the vertical direction, but may be arranged at different intervals.

Figure 10A:
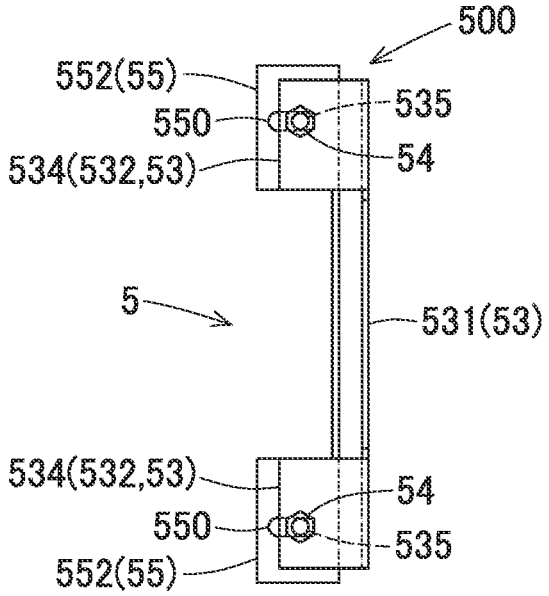
FIG. 10A is a right side view of the engagement device in which the engaging part is set at the first position.
Figure 10B:
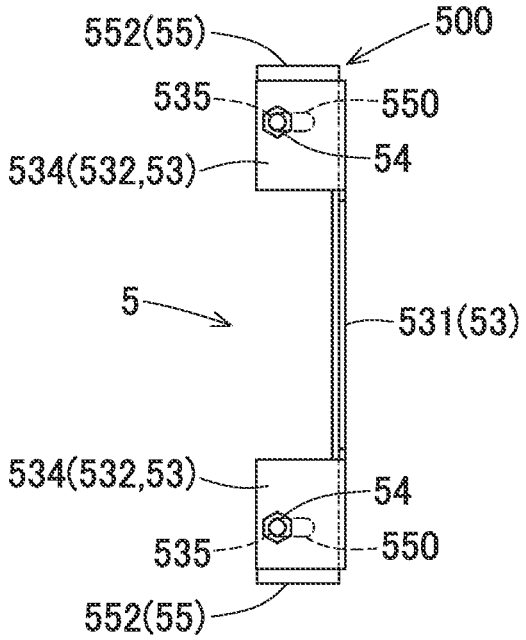
FIG. 10B is a right side view of the engagement device in which the engaging part is set at the second position.

Also, a plurality of elongated holes 550 of this embodiment are provided in the second support section 552 as shown in FIG. 10A and FIG. 10B. The elongated holes 550 are arranged in at least one pair of sections aligning in the vertical direction of the second extending section 557. Specifically, one elongated hole 550 is provided in each of the pair of sections to thereby provide two elongated holes 550 in the second support section 552.

The fixing part 54 is configured to pass through the elongated hole 550 to fix the position of the engaging part 50 changeably with respect to the aligning direction. The fixing part 54 of this embodiment is formed by the combination of a bolt and a nut, and a plurality of fixing parts 54 are provided. Specifically, each of the plurality of fixing parts 54 is configured to pass through the elongated hole 550 provided in the first support section 551 while passing through the screw hole 535 provided in the base 53, and/or pass through the elongated hole 550 provided in the second support section 552 while passing through the screw hole 535 provided in the base 53, to fix the base 53 to the engagement support part 55.

The fixing parts 54 of this embodiment are configured to respectively pass through the elongated holes 550 arranged at both ends in the vertical direction of the first support section 551 and at a position in an area between both ends in the vertical direction of the first support section 551 while respectively passing thorough the screw holes 535 provided in the base 53, to fix the first support section 551 and the base 53 (see FIG. 9) together. Thereby, the fixing parts 54 can tightly fix the first support section 551 and the base 53 together at three or more positions.

Figure 8:
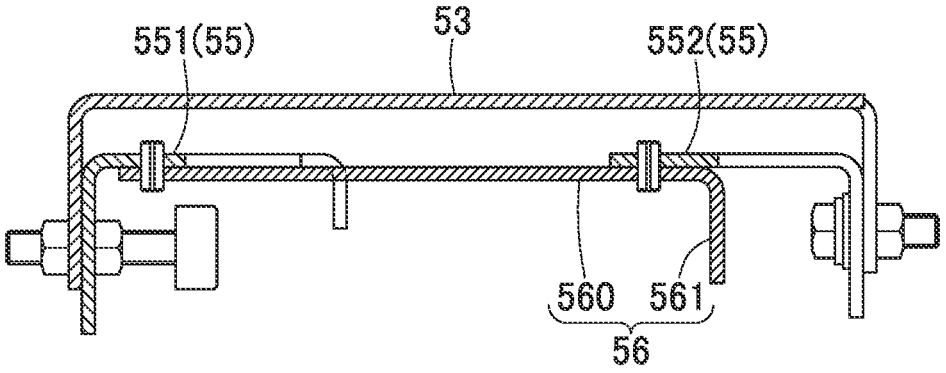
FIG. 8 is a cross sectional view taken along the line and viewed in the direction of arrows VIII-VIII in FIG. 4.

The interlock part 56 interlocks the first support section 551 and the second support section together as shown in FIG. 8. The interlock part 56 of this embodiment includes an interlock body section 560 expanding along the car door 42 (specifically, along the opposite surface 420 of the car door 42) (see FIG. 3 and FIG. 4). The interlock part 56 of this embodiment further includes an auxiliary restricting section 561 extending in the vertical direction and the aligning direction.

The auxiliary restricting section 561 of this embodiment is aligned with the engaging part 50 in the aligning direction. Thereby, the auxiliary restricting section 561 can come into contact with the engaging part 50 that has moved in the aligning direction. Specifically, the auxiliary restricting section 561 is located on the door opening direction side with respect to the second engaging section 52 in the aligning direction. Thereby, the auxiliary restricting section 561 can come into contact with the second engaging section 52 that has moved to the door opening direction side.

The link part 57 includes, for example, a first link section 571 that connects the first engaging section 51 to the base 53 so as to allow the first engaging section 51 to be movable relative to the base 53 in the opening and closing direction, and a second link section 572 that connects the second engaging section 52 to the base 53 so as to allow the second engaging section 52 to be movable relative to the base 53 in the opening and closing direction.

A pair of first link sections 571 are arranged, for example. The pair of first link sections 571 connect the base 53 to the first engaging section 51 and are arranged with a distance from each other in the vertical direction. Each of the first link sections 571 of this embodiment is connected to the first engaging section 51 to be relatively rotatable around a shaft extending in the depth direction. This configuration allows the pair of first link sections 571 to, together with the first engaging part 51, form a parallel link mechanism. Therefore, the first engaging part 51 can pivotally move (swing) with maintaining the position of the first holding surface 511 at which the first holding surface 511 faces a certain direction (i.e. the door opening direction) (specifically, the position at which the first holding surface 511 is parallel to the second holding surface 521). Each of the first link sections 571 of this embodiment has a rectangular plate shape.

In the engagement device 5 of this embodiment, the restricting part 59 is held in contact with the first link section 571 (specifically, of the pair of first link sections 571, the first link section 571 located on the lower side). Thereby, the first link section 571 is restricted from pivotally moving so that the first engaging section 51 is held in the state where it cannot pivotally move. The pivotal movement of the first engaging section 51 is enabled by adjusting the position of the restricting part 59 so as to allow the first link section 571 to pivotally move.

The restricting parts 59 are respectively mounted to, for example, the first extending section 554 of the first support section 551 and the auxiliary extending section 555. As described above, each of the restricting parts 59 is a member for restricting the range in which the first engaging section 51 can be pivotally movable. The restricting part 59 has a restricting contact surface that can come into contact with a surface of the first link section 571, which surface is located on the door opening direction side. Specifically, the restricting part 59 includes a columnar section in a columnar shape having a bottom surface that serves as the restricting contact surface, and a screw section extending from the columnar section and mounted to each of the first extending section 554 and the auxiliary extending section 555.

A pair of second link sections 572 are arranged, for example. The pair of second link sections 572 connect the base 53 to the second engaging section 52 and are arranged with a distance from each other in the vertical direction. Each of the second link sections 572 of this embodiment is connected to the second engaging section 52 to be relatively rotatable around a shaft extending in the depth direction. This configuration allows the pair of second link sections 572 to, together with the second engaging part 52, form a parallel link mechanism. Therefore, the second engaging part 52 can pivotally move (swing) with maintaining the position of the second holding surface 521 at which the second holding surface 521 faces a certain direction (i.e. the door closing direction) (specifically, the position at which the second holding surface 521 is parallel to the first holding surface 511). Each of the second link sections 572 of this embodiment has a rectangular plate shape.

The driving mechanism 58 drives the second engaging section 52 utilizing the opening and closing of the car door 42, to thereby allow the first engaging section 51 and the second engaging section 52 to hold (clamp) the engaged part 62 of the landing door 61. Specifically, the driving mechanism 58 includes a cam 581 that is pivotally movable around a shaft extending in the depth direction, a cam contact part 582 which the cam 581 contacts by the closing of the car door 42, and a connector 583 that connects the cam 581 with the second engaging section 52.

The cam 581 includes a cam body having a band plate shape in which the middle portion is bent, a contact roller arranged in the cam body, and a biasing member for biasing the cam body.

When the cam 581 pivotally moves, the connector 583 transmits the vertical movement caused by the pivotal movement to the second engaging section 52. Thereby, the connector 583 allows the second engaging section 52 to pivotally move.

The cam contact part 582 is fixed to, for example, the car body 31. The cam contact part 582 has a contact surface, which a contact roller of the cam 581 contacts, when the car door 42 closes. The contact surface allows the contact roller to come into contact therewith just before the car door 42 reaches the full-closed position in the door closing operation. The contact surface prevents the contact roller from moving further toward the door closing side when the car door 42 is further moved to close.

In adopting the aforementioned engagement device 5 in the elevator 1, the position of the engaging part 50 relative to the base 53 in the depth direction is adjusted to match with a distance L between a position L1 of the opposite surface 420 of the car door 42 facing the landing door 61 and a position L2 of the sill of the car 3 (hereinafter also referred to simply as "depth distance L"), and thereafter the engagement device 5 is mounted to the car door 42 (see FIG. 7A and FIG. 7B). The position L2 of the sill of the car 3 corresponds to the position of the end edge located on the landing floor 6 side of doorsills of the car 3 in FIG. 1.

Specifically, in the case where the depth distance L is large, the fixing part 54 is arranged in the elongated hole 550 of the engagement support part 55 at a position close to the car door 42 to have an increased distance between the engaging part 50 and the base 53 in the depth direction (see FIG. 7A, FIG. 9A, and FIG. 10A). At this time, the distance between the engaging body 500 and the base 53 in the depth direction increases. In the engagement device 5 of this embodiment, the base 53 and the engaging body 500 (specifically, the engagement support part 55) are separated from each other. In the case where a gap is generated between the car door 42 and the base 53 in the aligning direction, the gap may be filled with, for example, a spacer S.

In the case where the depth distance L is small, the fixing part 54 is arranged in the elongated hole 550 of the engagement support part 55 at a position away from the car door 42 to have a decreased distance between the engaging part 50 and the base 53 in the depth direction (see FIG. 7B, FIG. 9B, and FIG. 10B). At this time, the distance between the engaging body 500 and the base 53 in the depth direction decreases. In the engagement device 5 of this embodiment, the base 53 and the engaging body 500 (specifically, the engagement support part 55) come into contact with each other.

In the elevator 1 configured as described above, the engagement device 5 transmits the driving force (i.e. the driving force to open and close the car door 42) of the driving device 45 to the landing door 61, to thereby enable the landing door 61 to follow the opening and closing of the car door 42. That is, the landing door 61 of the landing floor 6 opens and closes in association with the car door 42 of the car 3. A specific description will be given below.

When the car 3 is raised or lowered within the elevator shaft 2 to stop at a desired floor, the engaged part (catch roller) 62 provided on the landing door 61 enters between the first engaging section 51 and the second engaging section 52 from above or below (see FIG. 5).

Subsequently, the driving device 45 drives the door hangers 43 to respectively move the car doors 42, which hang down from the door hangers 42, from the fully-closed position to the door opening position.

The first engaging section 51 (i.e. the first holding surface 511) comes into contact with the engaged part 62 of the landing door 61 when the car door 42 moves from the fully-closed position in the door opening direction.

Also at the time of the movement of the car door 42 from the fully-closed position in the door opening direction, the contact roller of the cam 581 separates from the cam contact part 582. Thereby, the second engaging section 52 pivotally moves toward the first engaging section 51 side due to the biasing force of the cam 581 to hold (clamp) the engaged part 62 together with the first member 52 therebetween (see FIG. 6).

In this state, when the car doors 42 respectively move further in the door opening direction, the engaged part 62 is pushed by the first engaging section 51 in the door opening direction, while being held between the first engaging section 51 and the second engaging section 52. Thereby, the landing doors 61 open along with the car doors 42.

On the other hand, when the doors close, the driving device 45 drives the door hangers 43 to respectively move the car doors 42, which hang down from the door hangers 43, from the fully-opened position in the door closing direction. At this time, the engaged part 62 is pushed by the second engaging section 52 in the door closing direction, while being held between the first engaging section 51 and the second engaging section 52. Thereby, the landing doors 61 close along with the car doors 42.

According to the engagement device 5, the position of the engaging part 50 relative to the base 53 is changeable in the aligning direction (depth direction) of the landing doors 61 and the car doors 42 at the time of opening and closing such doors (see FIG. 7A and FIG. 7B). Thus, the engaging part 50 can transmit the driving force to open and close the door on one side (specifically, car door 42) to the door on another side (specifically, landing door 61) by adjusting the position of the engaging part 50 in the depth direction to allow the engaging part 50 to be engageable with the engaged part 62 of the door on the other side (specifically, the landing door 61). Therefore, one type of engagement device 5 can be applied to the elevators 1 having different distances between the landing door 61 and the car door 42 in the depth direction (for example, the elevators 1 that having different distances between the position L1 of the opposite surface 420 of the car door 42 facing the landing door 61 and the position L2 of the sill of the car 3).

According to the engagement device 5 of this embodiment, the fixing part 54 is configured to pass through the elongated hole 550 of the engagement support part 55 so as to allow the position of the engaging part 50 to be changeable relative to the base 53 in the aligning direction. Therefore, the position of the engaging part 50 can be easily adjusted between the front side and the back side in the depth direction (i.e. the aligning direction) by adjusting the position at which the fixing part 54 is made to pass through the elongated hole 550.

According to the engagement device 5 of this embodiment, the first engaging section 51 and the second engaging section 52 are configured to clamp the engaged part 62 of the landing floor 6 from both sides in the door opening and closing direction in the state where the first engaging section 51 and the second engaging section 52 are connected to the base 53, which is connected to the car door 42, respectively by the link parts 57 (see FIG. 3 and FIG. 4). Therefore, the state where the engaged part 62 is being clamped by the first engaging section 51 and the second engaging section 52 can be stably maintained even when the doors are opened and closed. Also, the stiffness of the engagement support part (i.e. the engagement support part as a collective body of the first support section and the second support section) can be improved by the interlock part 56.

According to the engagement device 5 of this embodiment in which the second engaging section 52 can come into contact with the auxiliary restricting section 561 of the interlock part 56, the contact of the second engaging section 52 with the auxiliary restricting section 561 thus restricts the second engaging section 52, which is in contact with the auxiliary restricting section 561, from passing over (moving excessively) in the opening and closing direction (for example, in the door opening direction). Further, the auxiliary restricting section 561 extends from the interlock body section 560 that connects the first support section 551 and the second support section 552, so that the motions of the two support sections are synchronized with the motion of the auxiliary restricting section 561. Moreover, the force applied to the auxiliary restricting section 561 can be dissipated to the two support sections through the interlock body section 560 when the auxiliary restricting section 561 restricts the passing-over of the second engaging section 52.

Next, the present invention will be described by way of the second embodiment with reference to FIG. 11 to FIG. 14. The same reference signs will be applied to the same configurations as the first embodiment, and the detailed description will be given only for the different configurations.

Figure 11:
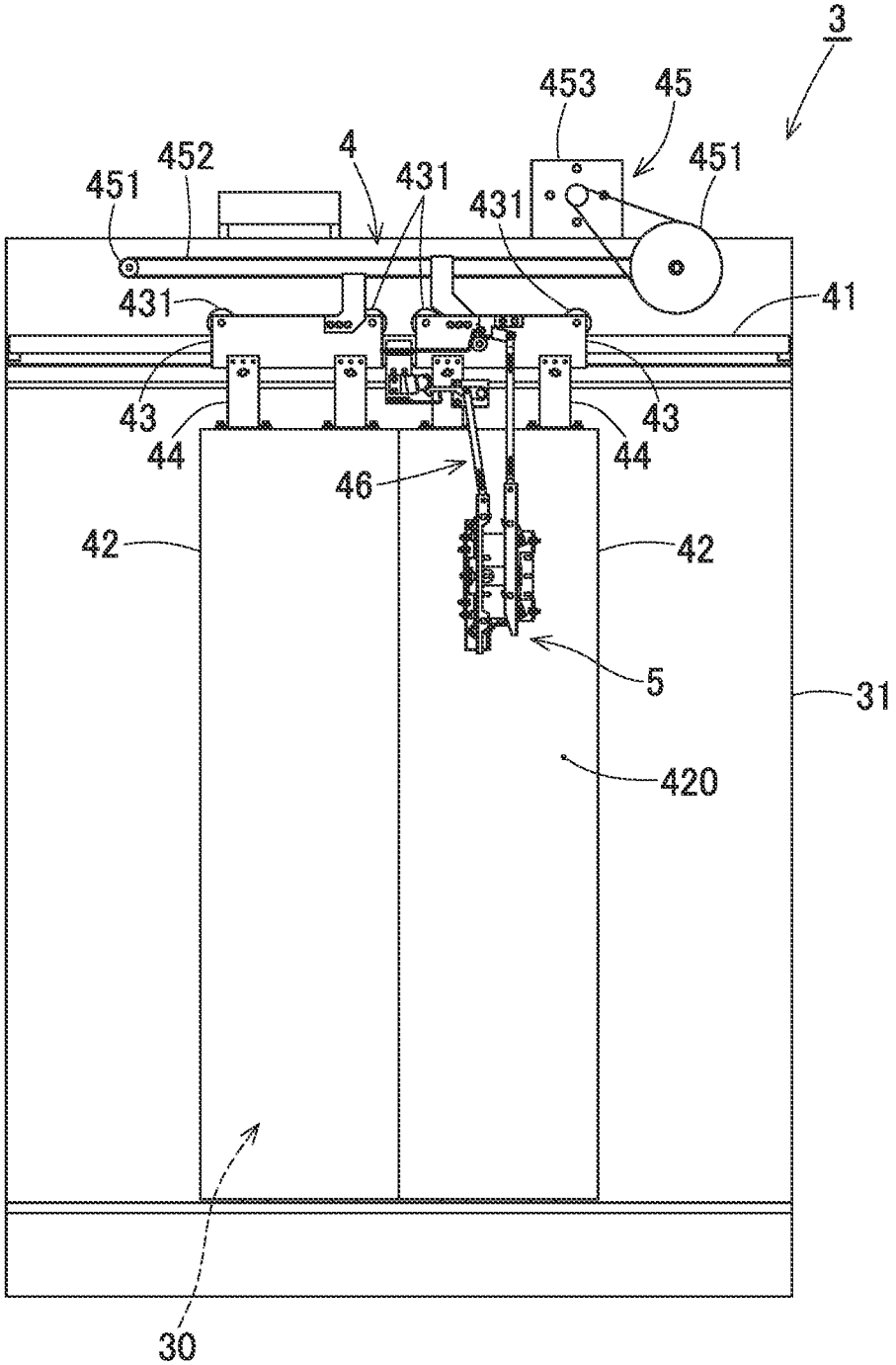
FIG. 11 is a front view of an elevator according to a second embodiment.

The door device 4 of this embodiment includes a locking mechanism 46 capable of locking the car door 42 as shown in FIG. 11. The locking mechanism 46 is configured to lock so as not to open the car door 42 when the car door 42 is at the fully-closed position, and unlock when the car door 42 moves from the fully-closed position in the door opening direction.

Figure 12:
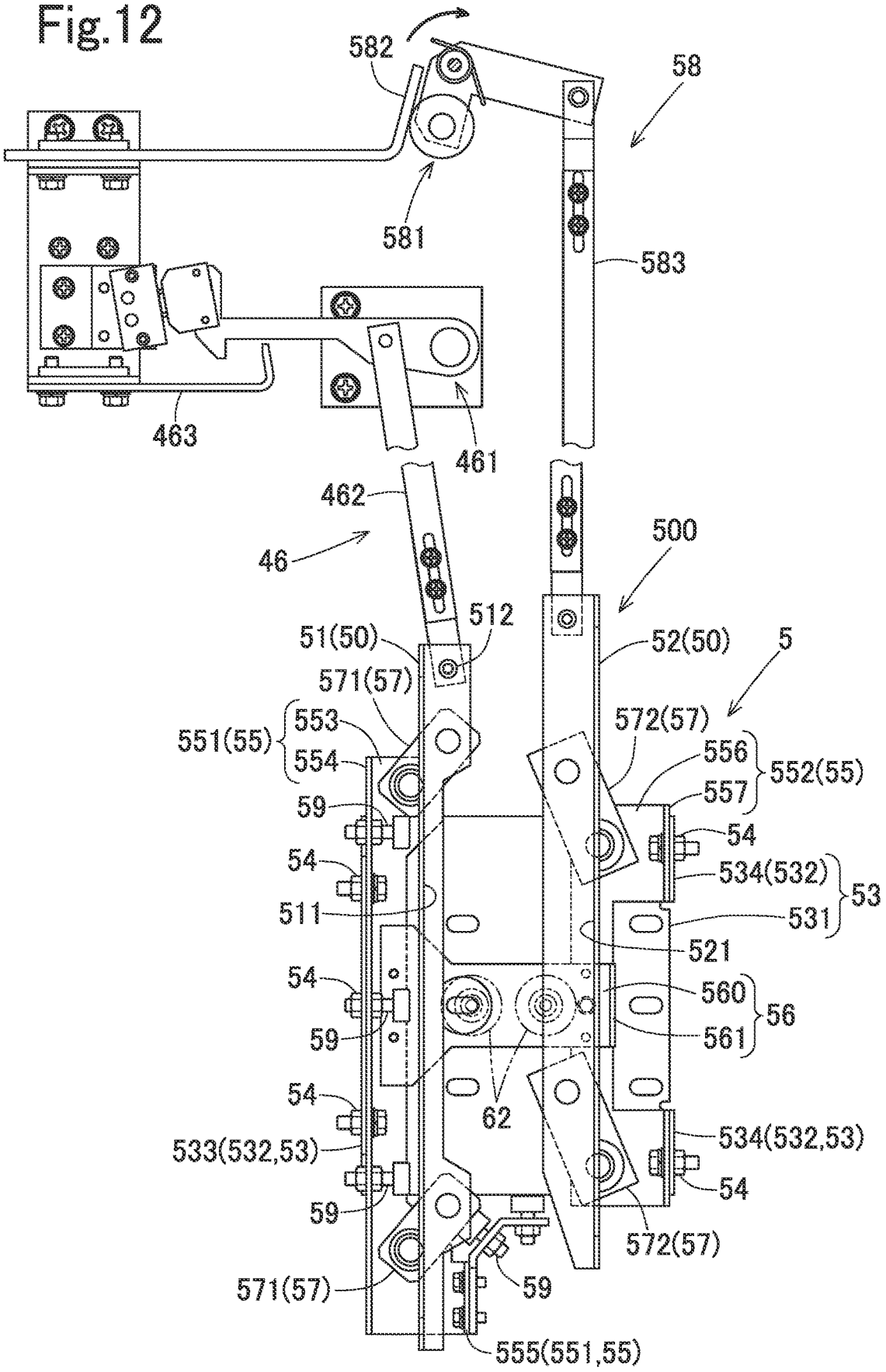
FIG. 12 is an explanatory diagram for the configuration of the engagement device arranged in a door device of the elevator in the state where the engagement device does not hold an engaged part of a landing door.
Figure 13:
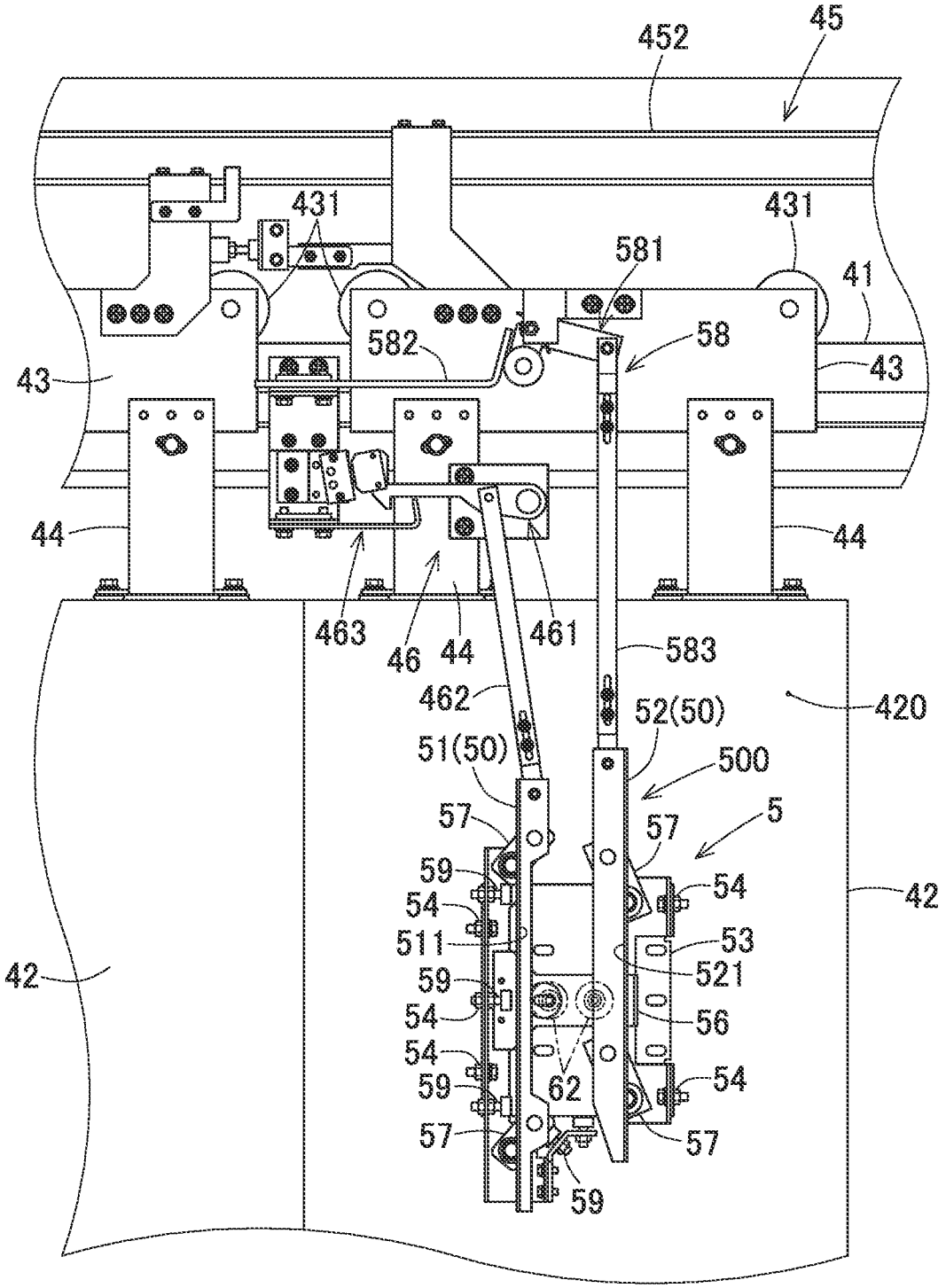
FIG. 13 is an explanatory diagram for the motion of the engagement device in the state where the engagement device does not hold the engaged part of the landing door.
Figure 14:
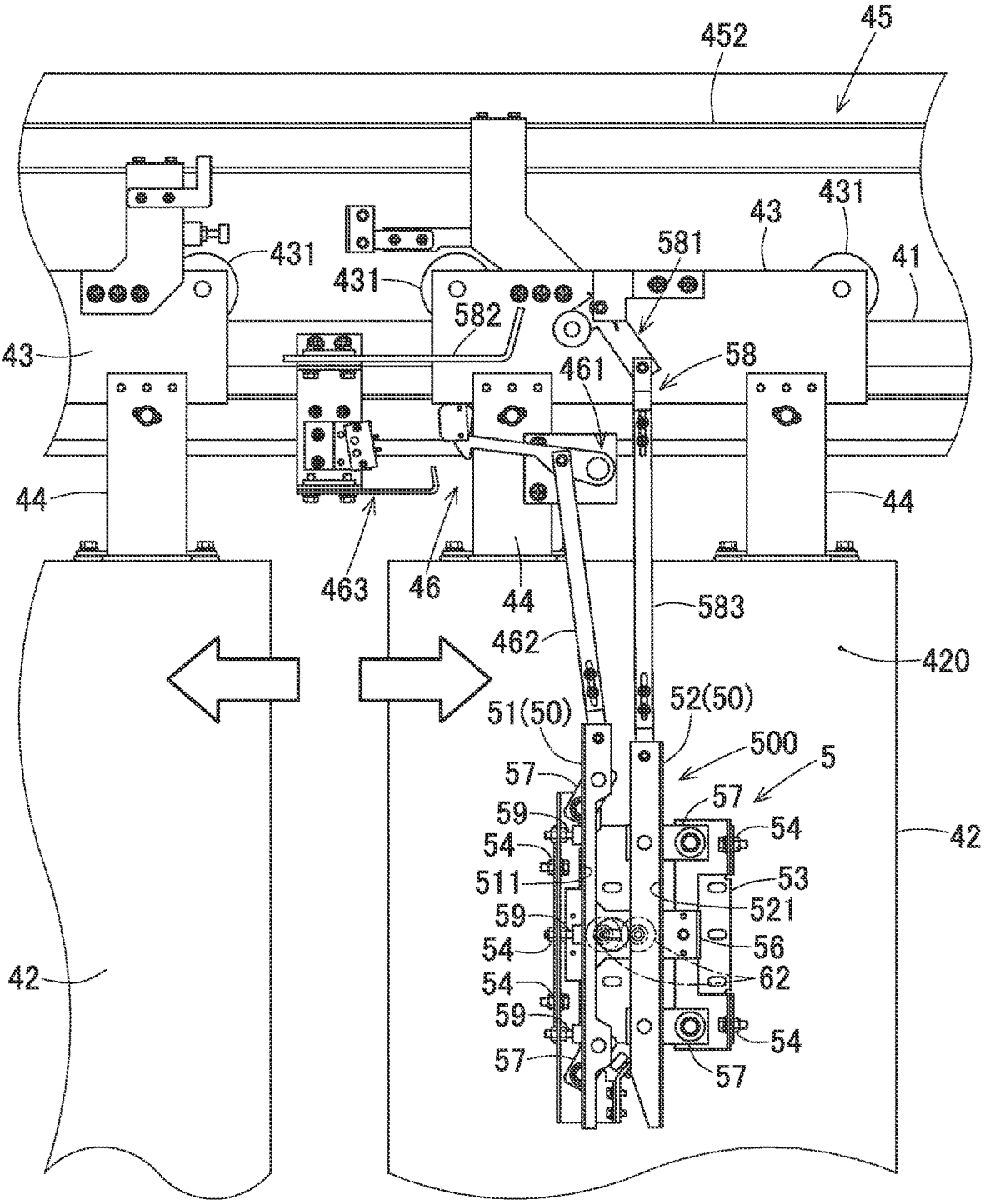
FIG. 14 is an explanatory diagram for the motion of the engagement device in the state where the engagement device holds the engaged part of the landing door.

Specifically, as shown in FIG. 12 to FIG. 14, the locking mechanism 46 includes a locking mechanism engaging part 461 that is mounted on the door hanger 43 or the intermediate member 44 arranged between the door hanger 43 and the car door 42, a transmission member 462 that transmits driving force from the engagement device 5 (i.e. the pivotal movement of the engaging section 51) to the locking mechanism engaging part 461, and a locking mechanism engaged part 463 that is mounted on the car body 31 or a member or part fixed to the car body 31. In the locking mechanism 46, the locking mechanism engaging part 461 engages with the locking mechanism engaged part 463 (comes into an engaging position), thereby locking the car door 42 from opening.

When the locking mechanism engaging part 461 is pushed upward through the transmission member 462 by the pivotal movement of the first engaging section 51 (from the state shown in FIG. 13 to the state shown in FIG. 14), the locking mechanism engaging part 461 pivotally moves to come into a position where it is out of engagement with the locking mechanism engaged part 463 (see FIG. 14). On the other hand, when the locking mechanism engaging part 461 is pulled downward through the transmission part 462 by the pivotal movement of the first engaging section 51 (from the state shown in FIG. 14 to the state shown in FIG. 13), the locking mechanism engaging part 461 pivotally moves to come into a position where it can engage with the locking mechanism engaged part 463 (see FIG. 13).

The transmission member 462 is connected to the connection part 512 of the first engaging section 51 in the engagement device 5 (see FIG. 12). The transmission member 462 connected to the connection part 512 transmits the driving force of the driving device 45 to the engaging part 461 by the connection of the first engaging section 51 with the locking mechanism engaging part 461. Specifically, the transmission member 462 transmits the pivotal movement (vertical movement) of the first engaging section 51 to the locking mechanism engaging part 461.

The locking mechanism 46 of the elevator 1 of this embodiment locks the car doors 42 by the closing of the car doors 42, and unlocks the car doors 42 by the opening of the car doors 42. The engagement device 5 is applicable to the elevator 1 provided with the locking mechanism 46.

The elevator door engagement device according to the present invention is not limited to the aforementioned embodiments, and it is a matter of course that various modifications can be made without departing from the gist of the present invention. For example, the configuration of a particular embodiment can be added to the configuration of another embodiment, and a part of the configuration of a particular embodiment can be replaced with the configuration of another embodiment. In addition, a part of the configuration of a particular embodiment can be eliminated.

The engagement device 5 in the aforementioned embodiments is mounted to the car door 42, but may be mounted to the landing door 61 (specifically, the opposite surface of the landing door 61 facing to the car door 42). In this case, the door device 1 including the driving device 45 and the like is arranged in the landing floor 6. In the engagement device 5 mounted to the landing door 61, the engaging part 50 is configured to engage with the engaged part of the car door 42, and thereby is able to transmit the driving force to open and close the landing door 61 to the car body 42. The base 53 is connected to the landing door 61 and the engaging body 500.

In the engagement device 5 of the aforementioned embodiments, the elongated holes 550 are provided in both of the first support section 551 and the second support section 552, but may be provided in either one of the first support section 551 and the second support section 552. The elongated hole 550 may be provided in the engaging body 500 or the base 53. In this case, there are no limitations on the position and the number of the elongated hole(s) 550 to be arranged. In the case where, for example, the elongated hole 550 is provided in the base 53, a screw hole may be provided in the first support section 551 or the second support section 552. In this configuration, the position of the engaging part 50 is changeable relative to the base 53 by allowing the fixing part 54 to pass through the screw hole in the first support section 551 or the second support section 552 and the elongated hole 550 of the base 53.

It is not necessary to provide the elongated hole 550 that is served for changeably fixing the position of the engaging part 50 relative to the base 53 in the aligning direction at the time of opening and closing the doors. For example, through holes may be provided in the engaging part 50 or the base 53 at different positions in the aligning direction to allow the fixing part 54 to change the through hole to pass therethrough. Thereby, the position of the engaging part 50 relative to the base 53 is changeable in the aligning direction at the time of opening and closing the doors. In this configuration, the position of the engaging part 50 relative to the base 53 is changed not in the non-stepwise manner as the aforementioned embodiments, but in a stepwise manner (in an intermittent manner).

As an alternative to the combination of the through hole provided in the engaging body 500 or the base 53 and the fixing part 54 such as a bolt, the combination of, for example, a recess and a projection may be used. In this case, the position of the engaging part 50 relative to the base 53 is changed in the non-stepwise manner.

Each of the first engaging section 51 and the second engaging section 52 of the aforementioned embodiments has an angular shape, but not limited to this shape. As long as the first engaging section 51 has a shape having the first holding surface 511, the first engaging section 51 may have any shape such as a plate shape having the first holding surface 511. Same applies to the shape of the second engaging section 52.

The base 53 of the aforementioned embodiments is configured to have the base body section 531, the first base extending section 533, and the second base extending section 534, but not limited thereto. That is, the base 53 is not limited to a specific configuration.

The fixing part 54 of the aforementioned embodiments is a bolt, but may be any fixing member such as a rivet or a split pin as long as it can pass through the through hole.

The interlock part 56 of the aforementioned embodiments is provided with the auxiliary restricting section 561, but may not be provided with this section. Even in this case, the stiffness of the engagement support part 55 can be improved as long as the interlock part 56 connects the first support section 551 and the second support section 552. The engaging body 500 may not include the interlock part 56, and, in this case, the number of parts or members constituting the engaging body 500 can be reduced.

The link part 57 of the aforementioned embodiments is configured to have the first link section 571 and the second link section 572, but not limited thereto. That is, the link part 57 is not limited to a specific configuration.

In the engagement device 5 of the aforementioned embodiments, the connection part 512 of the first engaging section 51 has a shaft bush with a hole through which a bolt is insertable or a shaft bush for receiving the bolt, but not limited thereto. That is, the connection part 512 of the first engaging section 51 is not limited to a specific configuration.

In the engagement device 5 of the aforementioned embodiments, the fixing part 54 is made to pass through the elongated hole 550 provided in the engagement support part 55 to allow the position of the engaging part 50 to be changeable relative to the base 53 in the aligning direction of the landing door 61 and the car door 42 at the time of opening and closing. However, the position of the engaging part 50 in the aligning direction may be changeable by another configuration in addition to this configuration.

Figure 15:
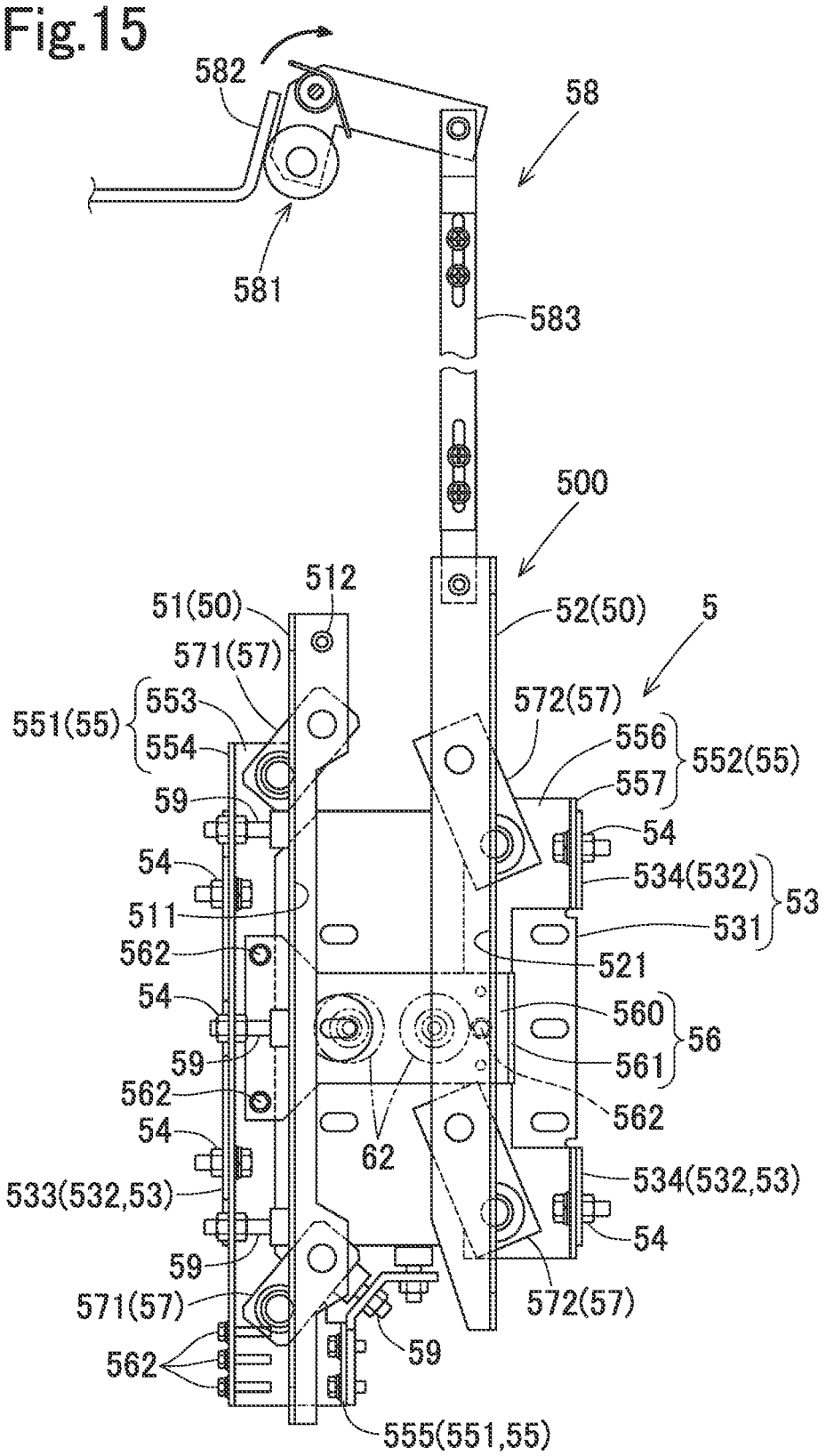
FIG. 15 is an explanatory diagram for the configuration of the engagement device according to a variation in the state where the engagement device does not hold an engaged part of a landing door.
Figure 16:
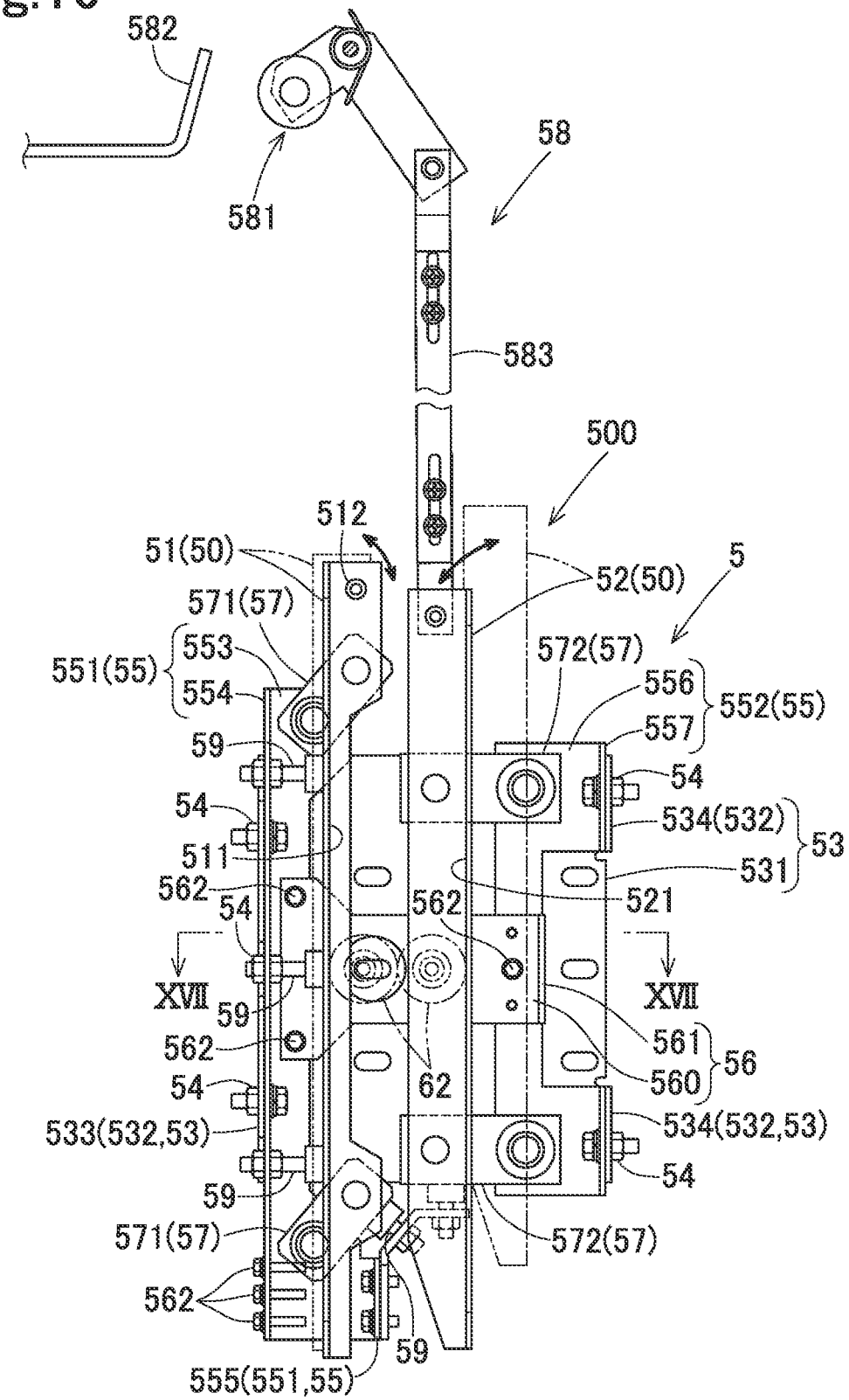
FIG. 16 is an explanatory diagram for the configuration of the engagement device in the state where the engagement device holds the engaged part of the landing door.
Figure 17:
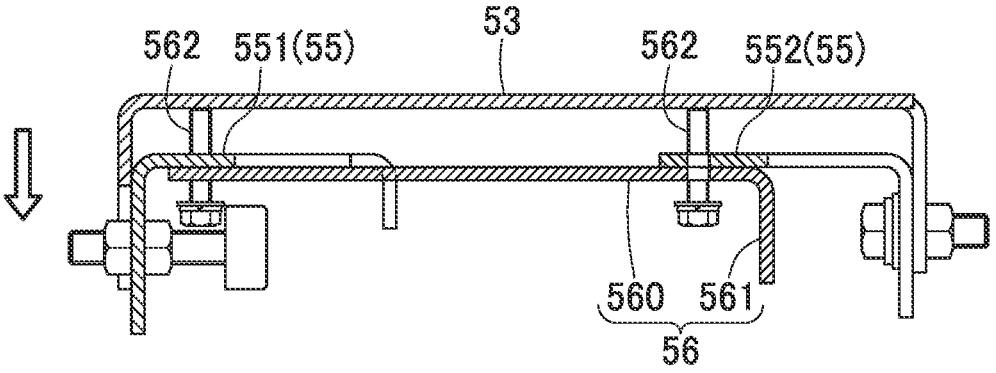
FIG. 17 is a schematic explanatory diagram for position adjustment in the engagement device.

For example, a jack member 562, which is configured to jack up the first support section 551 and the second support section 552 in the aligning direction to allow the positions of the first support section 551 and the second support section 552 to be changeable in the aligning direction, may be provided as shown in FIG. 15 to FIG. 17. In this case, the position of the engaging part 50 in the aligning direction is changeable through the jack-up of the first support section 551 and the second support section 552 by the jack member 562. Thereby, the position of the engaging part 50 relative to the base 53 is changeable in the direction away from the base 53 in the aligning direction.

According to this configuration, the position of the engaging part 50 can be further adjusted between the front side and the back side in the depth direction (i.e. the aligning direction) by the jack-up of the first support section 551 and the second support section 552.

At least one jack member 562 may be provided in each of the first support section 551 and the second support section 552. For example, a total of three jack members 562 may be provided by arranging two jack members 562 in the first support section 551 and one jack member 562 in the second support section 552. In the case where a plurality of jack member 562 are provided in the first support section 551 or the second support section 552, the plurality of jack members 562 are arranged to be separated from each other in the vertical direction.

The jack member 562 is, for example, a jack bolt. The jack member 562 may additionally jack up the interlock part 56 at the time of the jack-up of the first support section 551 and the second support section 552.

More specifically, screw holes are provided in the interlock part 56 at positions at which the screw holes respectively overlap with the screw holes in the first support section 551 and the second support section 552; the jack members 562 are allowed to respectively pass through the screw hole extending through the first support section 551 and the interlock part 56 and the screw hole extending through the second support section 552 and the interlock part 56; and the first support section 551, the second support section 552, and the interlock part 56 are jacked up by the jack members 562 which are rotated and screwed into the respective screw holes.

In this configuration, the first support section 551 and the second support section 552 are jacked up in a stable state because the interlock part 56 that interlocks the first support section 551 and the second support section 552 is also jacked up at the time of the jack-up of the first support section 551 and the second support section 552.

In the case where the position of the engaging part 50 relative to the base 53 in the aligning direction is desired to be located close to the base 53 (in the case where the position is desired to be displaced in the direction opposite to the arrow direction in FIG. 17), the first support section 551 and the second support section 552 may be lightly pushed at their ends on the far side from the base 53 in the direction toward the base 53 (in the direction opposite to the direction represented by the arrow in FIG. 17).

The locking mechanism 46 in the door device 4 is also not limited to a specific configuration. The locking mechanism 46 may have any configuration as long as it can lock or unlock the car door 42 or the landing doors 61 by utilizing the pivotal movement of the first engaging section 51.

The engagement device 5 of the aforementioned embodiments is mounted to the car door panel on the right side of the two car door panels together constituting the car door 42 as viewed from the landing floor side, but may be mounted to the car door panel on the left side.

The door device 4 of the aforementioned embodiments is a so-called center open type door in which two (a plurality of) car door panels constituting the car door 42 open toward both sides in the width direction of the entrance 30, but not limited thereto. The door device 4 may be a so-called single door type door device in which the car door 42 opens toward one side in the width direction of the entrance 30.

The car door 42 of the aforementioned embodiments is composed of the two car door panels, but the car door 42 may be composed of a single door panel or a plurality of door panels such as three or more door panels. Same applies to the landing door panel(s) provided in the landing floor.

The elevator door engagement device of the present invention is a door engagement device configured to be mounted to an opposite surface of a car door facing a landing door or an opposite surface of the landing door facing the car door, the elevator door engagement device including: an engaging body including an engaging part, the engaging part being configured to engage with an engaged part provided on a driven door that is either one of the landing door and the car door, and transmit a driving force that moves a driving door in an opening and closing direction to the driven door, the driving door being the remaining one of the landing door and the car door; and a base that is connected to the driving door and the engaging body, wherein the position of the engaging part is changeable relative to the base in an aligning direction, in which the landing door and the car door align with each other when the landing and car doors are opened and closed.

According to this configuration, the engaging part can transmit the driving force to open and close the driving door that is the remaining one of the landing door and the car door to the one of the landing door and the car door by adjusting the position of the engaging part in the aligning direction (depth direction) of the landing door and the car door at the time of opening and closing so as to allow the engaging part to be engageable with the engaged part of the one of the car door and the landing door. Therefore, a single type of door engagement device can be applied to elevators having different distances between the landing door and the car door in the depth direction.

The door engagement device may be configured such that the engaging body or the base has an elongated hole extending in the aligning direction, and the elevator door engagement device further includes a fixing part that is configured to pass through the elongated hole to fix the engaging part so as to allow the position of the engaging part to be changeable with respect to the aligning direction.

According to this configuration, the position of the engaging part can be easily adjusted between the front side and the back side in the depth direction (i.e. the aligning direction) by adjusting the position in the elongated hole at which the fixing part is made to pass therethrough.

The door engagement device may be configured such that the engaging part includes: a first engaging section that extends in a vertical direction; and a second engaging section that extends in the vertical direction and aligns with the first engaging section in the opening and closing direction so as to be able to clamp the engaged part in cooperation with the first engaging section, and the engaging body further includes: an engagement support part that supports the engaging part, and includes a first support section that supports the first engaging section and a second support section that supports the second engaging section; an interlock part that interlocks the first support section and the second support section together; and a link part that is provided between the engaging part and the base, and includes: a first link section that connects the first engaging section to the base so as to allow the first engaging section to be movable relative to the base in the opening and closing direction; and a second link section that connects the second engaging section to the base so as to allow the second engaging section to be movable relative to the base in the opening and closing direction.

According to this configuration, the first engaging section and the second engaging section are configured to clamp the engaged part of the driven door from both sides in the door opening and closing direction in the state where the first engaging section and the second engaging section are connected to the base, which is connected to the driving door, respectively by the link parts. Therefore, the state where the engaged part is being clamped by the first engaging section and the second engaging section can be stably maintained even when the doors are opened and closed. Also, the stiffness of the engagement support part (i.e. the engagement support part as a collective body of the first support section and the second support section) can be improved by the interlock part.

The door engagement device may be configured such that the interlock part includes an auxiliary restricting section that extends in the vertical direction and the aligning direction and is configured to be able to come into contact with the second engaging section to thereby restrict the second engaging section from moving in the opening and closing direction.

According to this configuration, the contact of the first engaging section or the second engaging section with the auxiliary restricting section thus restricts the engaging section, which is in contact with the auxiliary restricting section, from passing over (moving excessively) in the opening and closing direction.

The door engagement device may be configured such that the engaging part includes: a first engaging section that extends in a vertical direction; and a second engaging section that extends in the vertical direction and aligns with the first engaging section in the opening and closing direction of the landing and car doors so as to be able to clamp the engaged part in cooperation with the first engaging section, and the engaging body further includes: an engagement support part that supports the engaging part, and includes a first support section that supports the first engaging section and a second support section that supports the second engaging section, each of the first support section and the second support section is provided with a jack member that is configured to jack up the first support section and the second support section so as to allow the positions of the first support section and the second support section to be changeable with respect to the aligning direction, and the position of the engaging part is changeable with respect to the aligning direction by the jack-up of the first support section and the second support section by the jack member.

According to this configuration, the position of the engaging part can be further adjusted between the front side and the back side in the depth direction (i.e. the aligning direction) by the jack-up of the first support section and the second support section.

The door engagement device may be configured such that the engaging body includes an interlock part that interlocks the first support section and the second support section together, and the jack member is configured to jack up the interlock part at the time of the jack-up of the first support section and the second support section.

According to this configuration, the first support section and the second support section are jacked up in a stable state because the interlock part that interlocks the first support section and the second support section is also jacked up at the time of the jack-up of the first support section and the second support section.

Although the elevator door engagement device of this embodiment is as described above, the present invention is not limited to the aforementioned embodiments and the design may be appropriately changed within the scope where the present invention is intended. Also, the functional effect of the present invention is not limited to the aforementioned embodiments. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

What is claimed is:

1. An elevator door engagement device configured to be mounted to an opposite surface of a car door facing a landing door or an opposite surface of the landing door facing the car door, the elevator door engagement device comprising:

an engaging body comprising an engaging part, the engaging part being configured to engage with an engaged part provided on a driven door that is either one of the landing door and the car door, and transmit a driving force that moves a driving door in an opening and closing direction to the driven door, the driving door being the remaining one of the landing door and the car door; and a base that is connected to the driving door and the engaging body, wherein a position of the engaging part is changeable relative to the base in an aligning direction perpendicular to the opposite surface of the car door facing the landing door or the opposite surface of the landing door facing the car door, in which the landing door and the car door align with each other when the landing doors and the car doors are opened and closed, and wherein the position of the engaging part in the aligning direction relative to the base is fixed during operation.

2. The elevator door engagement device according to claim 1, wherein the engaging body or the base has an elongated hole extending in the aligning direction, and the elevator door engagement device further comprises a fixing part that is configured to pass through the elongated hole to fix the engaging part so as to allow the position of the engaging part to be changeable with respect to the aligning direction.

3. The elevator door engagement device according to claim 2, wherein the engaging part comprises:

a first engaging section that extends in a vertical direction; and a second engaging section that extends in the vertical direction and aligns with the first engaging section in the opening and closing direction so as to be able to clamp the engaged part in cooperation with the first engaging section, and the engaging body further comprises:

an engagement support part that supports the engaging part, and comprises a first support section that supports the first engaging section and a second support section that supports the second engaging section;

an interlock part that interlocks the first support section and the second support section together; and a link part that is provided between the engaging part and the base, and comprises:

a first link section that connects the first engaging section to the base so as to allow the first engaging section to be movable relative to the base in the opening and closing direction; and a second link section that connects the second engaging section to the base so as to allow the second engaging section to be movable relative to the base in the opening and closing direction.

4. The elevator door engagement device according to claim 3, wherein the interlock part comprises an auxiliary restricting section that extends in the vertical direction and the aligning direction and is configured to be able to come into contact with the second engaging section to thereby restrict the second engaging section from moving in the opening and closing direction.

5. The elevator door engagement device according to claim 2, wherein the engaging part comprises:

a first engaging section that extends in a vertical direction; and a second engaging section that extends in the vertical direction and aligns with the first engaging section in the opening and closing direction of the landing doors and the car doors so as to be able to clamp the engaged part in cooperation with the first engaging section, and the engaging body further comprises:

an engagement support part that supports the engaging part, and comprises a first support section that supports the first engaging section and a second support section that supports the second engaging section, each of the first support section and the second support section is provided with a jack member that is configured to jack up the first support section and the second support section so as to allow the positions of the first support section and the second support section to be changeable with respect to the aligning direction, and the position of the engaging part is changeable with respect to the aligning direction through the jack-up of the first support section and the second support section by the jack member.

6. The elevator door engagement device according to claim 5, wherein the engaging body comprises an interlock part that interlocks the first support section and the second support section together, and the jack member is configured to jack up the interlock part at the time of the jack-up of the first support section and the second support section.

* * * * *